US005441379A

United States Patent [19]

Gilbert, Jr.

[11] Patent Number: 5,441,379

[45] Date of Patent: Aug. 15, 1995

[54] HAND CART FOR WALL PANEL ASSEMBLY

[76] Inventor: J. Macklin Gilbert, Jr., 931 N. 2nd Ave., Rome, Ga. 30161

[21] Appl. No.: 146,966

[22] Filed: Nov. 2, 1993

Related U.S. Application Data

[62] Division of Ser. No. 840,103, Feb. 24, 1992, Pat. No. 5,277,013.

[51] Int. Cl.[6] ..... B65G 7/00

[52] U.S. Cl. ..... 414/494; 414/11

[58] Field of Search ..... 414/11, 494, 491, 559

[56] References Cited

U.S. PATENT DOCUMENTS

| | | | |
|---|---|---|---|
| 2,828,870 | 4/1958 | Corley | 414/11 |
| 2,851,279 | 9/1958 | Burg et al. | 280/79.1 |
| 3,641,724 | 2/1972 | Palmer | 52/615 |
| 3,732,138 | 5/1973 | Almog | 161/43 |
| 3,790,003 | 2/1974 | Tauscheck | 414/494 |
| 3,885,008 | 5/1975 | Martin | 264/45.3 |
| 3,952,471 | 4/1976 | Mooney | 52/602 |
| 3,954,189 | 5/1976 | Sherritt | 414/11 |
| 4,037,381 | 7/1977 | Charles | 52/627 |
| 4,046,362 | 9/1977 | Spillers | 269/43 |
| 4,117,939 | 10/1978 | Haddock | 414/11 |
| 4,175,899 | 11/1979 | Tipton | 414/11 |
| 4,228,985 | 10/1980 | Gaudelli et al. | 249/93 |
| 4,291,513 | 9/1981 | Ankarswed | 52/284 |
| 4,394,106 | 7/1983 | Frees et al. | 414/11 X |
| 4,481,743 | 11/1984 | Jellen | 52/64 |
| 4,482,669 | 6/1985 | Considine | 156/288 |
| 4,541,618 | 9/1985 | Bruno | 269/41 |
| 4,602,467 | 7/1986 | Schilger | 52/319 |
| 4,655,024 | 4/1987 | Grace et al. | 52/745 |
| 4,682,926 | 7/1987 | Chambers et al. | 414/11 |
| 4,770,592 | 9/1988 | Winter | 414/494 X |
| 4,894,974 | 1/1990 | Mayhew et al. | 52/785 |
| 4,934,720 | 6/1990 | Dobron | 280/79.11 |

FOREIGN PATENT DOCUMENTS 2215054 6/1973 Germany .

*Primary Examiner*—David A. Bucci
*Attorney, Agent, or Firm*—Jones & Askew

[57] ABSTRACT

The present invention provides an improved cart for transporting and erecting modular wall panels. The cart comprises a table pivotally attached to a wheeled frame with a hydraulic cylinder pivotally connected there between. The hydraulic cylinder pivots the table from a wall panel loading position to a wall panel unloading position. Wall panels are loaded onto the table in a near horizontal position by a winch assembly at a front end. The winch assembly holds a loaded panel against a stop bracket at the back end of the table during transport. When the cart is properly positioned with respect to a building, the hydraulic cylinder elevates the table to a near vertical position with the stop bracket providing support for the elevated panel. When the panel is fully elevated to the unloading position, the stop bracket rest on a slab of the building to allow the panel to be easily removed from the cart. The panel may then be secured to the slab and to the adjacent wall panels.

4 Claims, 19 Drawing Sheets

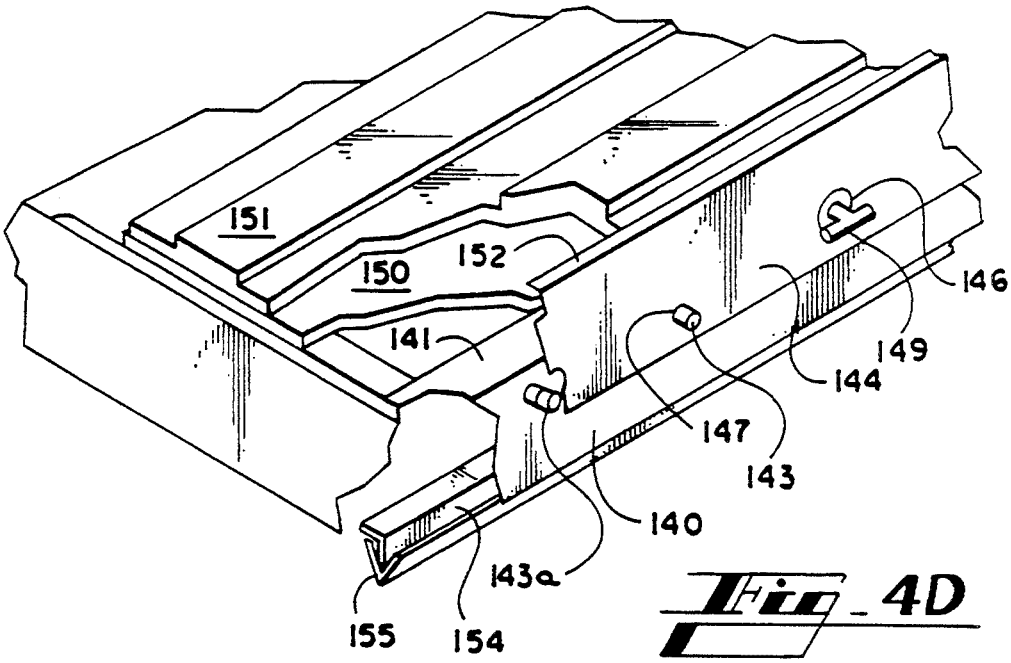
Fig_4D
Fig_4E
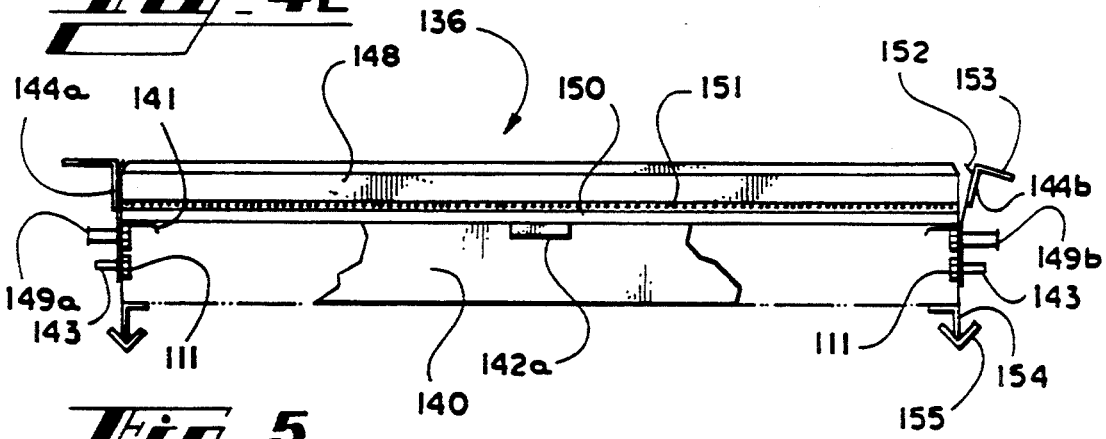
Fig_5
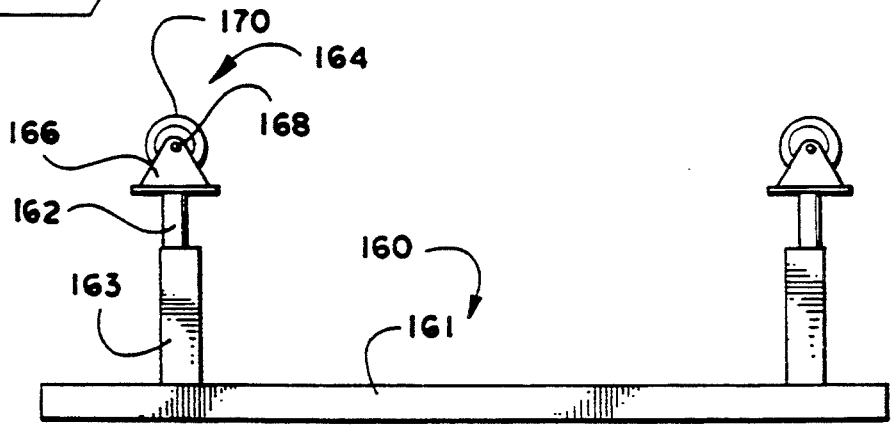

Fig_6C
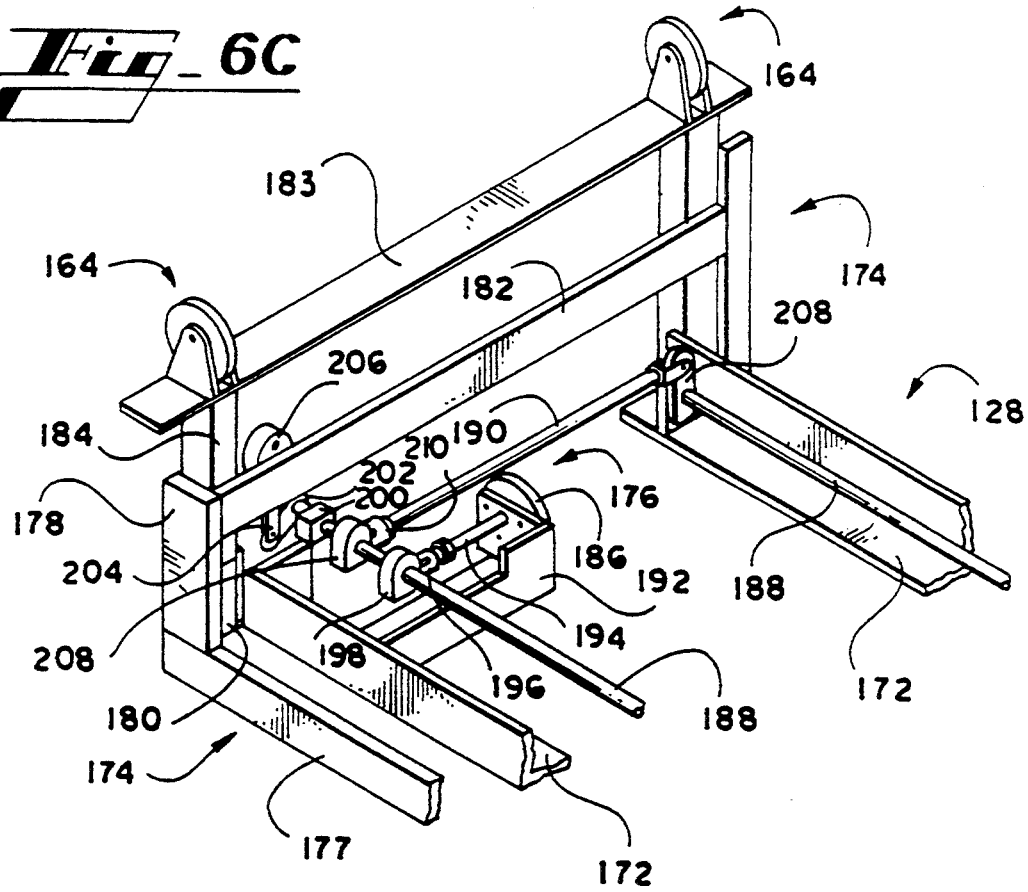
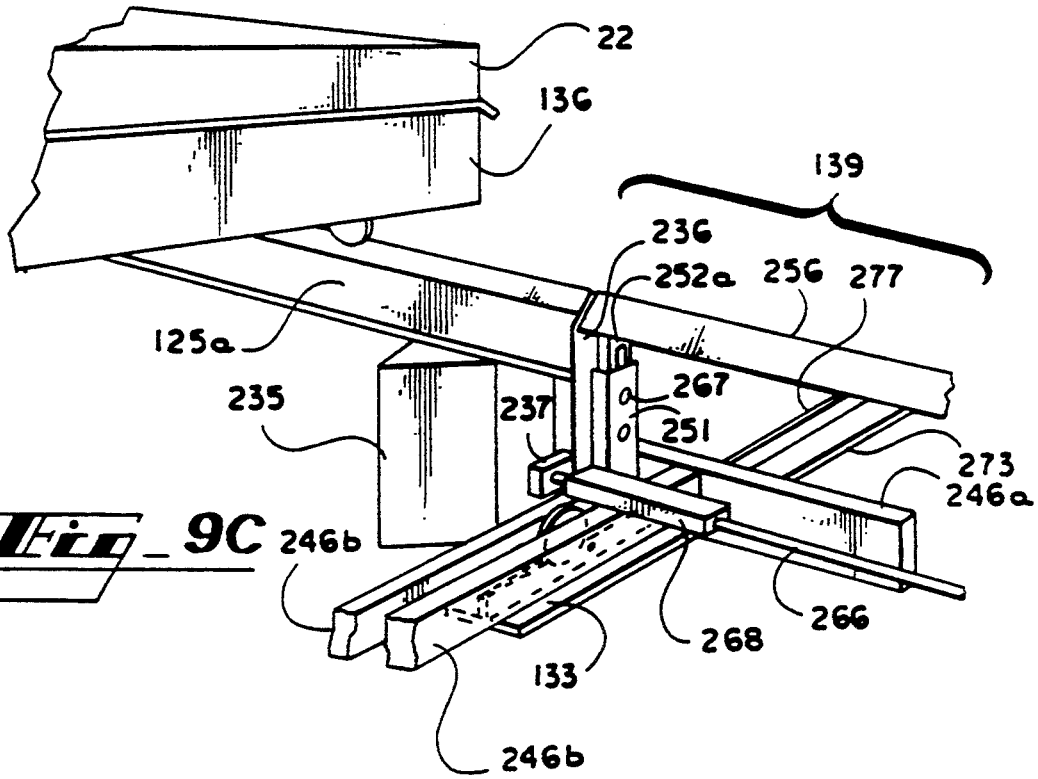
Fig_9C 274
268
266
246a
271
260
256
252b
251b
254
270
271
272
246b
244
139
248
250
251
252
265
267

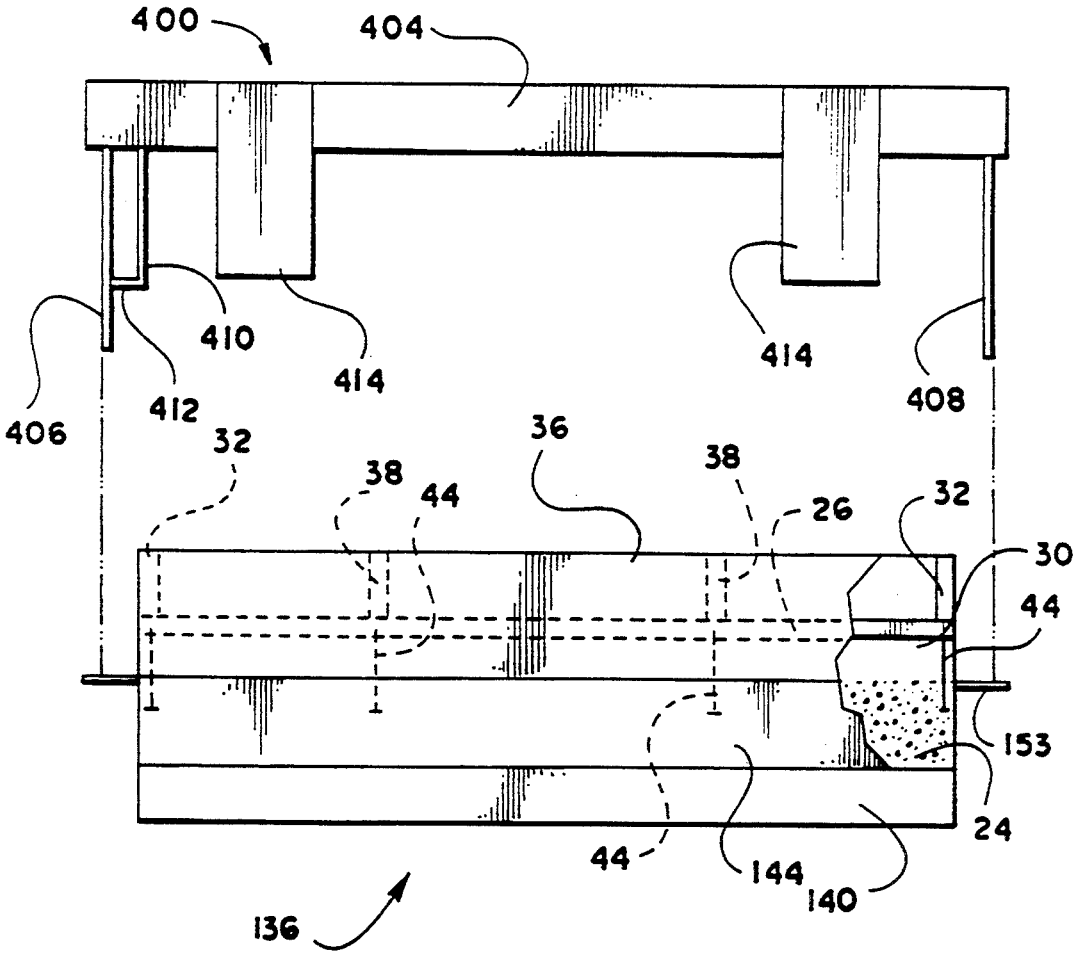
Fig. 12A
Fig. 12B
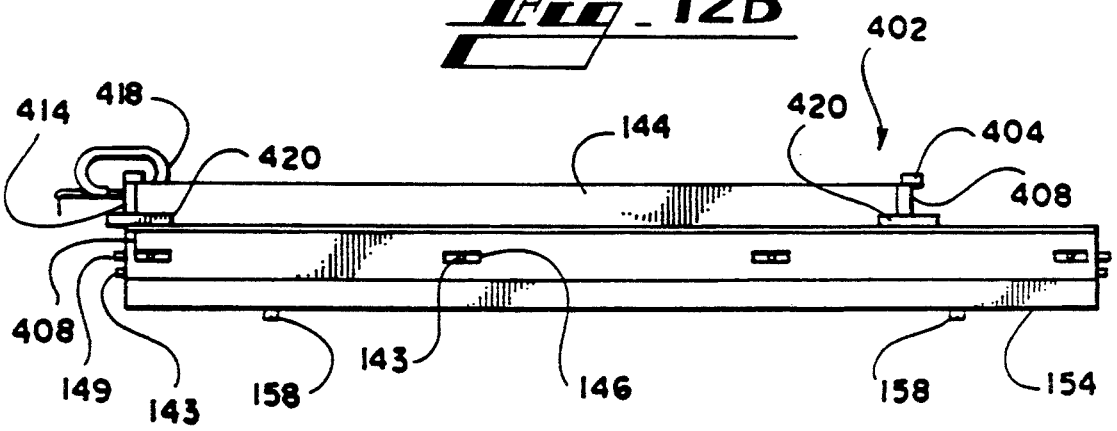

502
518
522
522b
522a
520
528
501
526
524
516
510
516
511
512
512
526
506a
482
D
508
507
507
500
486
C
24
32
34
26
24

HAND CART FOR WALL PANEL ASSEMBLY

This is a division of application Ser. No. 07/840,103, filed Feb. 24, 1992, now U.S. Pat. No. 5,277,013.

TECHNICAL FIELD

The present invention relates to modular building construction. More particularly, the present invention relates to a preformed wall panel, a method for making the preformed wall panel, a method for constructing walls of a modular building, and a wall constructed therefrom.

BACKGROUND OF THE INVENTION

The erection of low rise, slab foundation buildings has been simplified by development of modular construction techniques. Such low-rise buildings are used typically as houses, warehouses, office buildings and stores in shopping centers. Some such buildings are typically erected on poured concrete slab foundations. With conventional construction techniques, stud walls are prepared and secured to the foundation. The walls support rafters that span the foundation, and a roof is secured to the rafters. Interior walls subdivide the foundation and further support the rafters. Such a stick-frame building is closed-in by installing siding of various materials. Typically, several layers of siding materials are used, and these include fiber insulation boards, construction board sheets, and exterior skin materials such as brick, concrete, or wood siding. Insulation as appropriate is installed on the interior spaces between the studs. The interior walls are then typically closed with sheets of dry wall material.

Such extensive work typically required for on-site construction of stick-frame building is laborious, expensive, and time consuming. Weather conditions may also delay the construction schedule until the building is closed in.

Modular construction techniques, however, overcome some of these problems. These techniques include the use of modular panels for assembling the exterior walls. Generally, the modular panels include a support frame and an exterior skin. The modular panels are positioned in sequence around the foundation and are joined together. The exterior wall accordingly is closed-in as the building is assembled. U.S. Pat. No. 4,291,513 issued to Ankarswed describes a wall construction unit for buildings. A reinforced concrete layer constitutes the exterior face of the building. Longitudinal flanges extend from the concrete layer toward the interior of the building. Joists and intermediate insulation join the free end of the flanges and insulation is placed in the spaces between adjacent flanges. The insulation prevents formation of cold bridges between the exterior and interior of the building. The wall construction unit also includes a prolonged portion of the concrete layer extending from one flange, an intermediate portion extending from the end of the prolonged portion at fight angles and parallel with the flanges, and a terminating flange extending at fight angles from the end of the intermediate portion inwardly towards the adjacent flange. In cross-sectional view, these flanges in the prolonged portion partially close a substantially rectangular space which is filled with insulation. This rectangular section of the wall unit facilitates forming comers with a pair of such wall units.

U.S. Pat. No. 4,037,381 issued to Charles describes a panel with an exterior stucco surface. The panel attaches to adjacent studs of a building wall. The panel comprises a rectangular metal frame, a stucco sheet, and a plurality of metal tabs attached to the longer sides of the metal frames at vertically spaced intervals. The panel is assembled by placing the frame on a support with a sheet of felt paper in the frame. Cementitious material is poured onto the paper and cured. A rib lath is set on top and a second layer of cementitious material is poured. The cured panels are fastened to the framing studs by nailing through the metal tabs into the stubs.

U.S. Pat. No. 3,952,471 issued to Mooney describes prefabricated wall panels for a building. The building is constructed of load-bearing wall panels in combination with in-fill wall panels. The load-bearing panels include an integral subground level portion. This lower portion forms the foundation wall and rests on the footing of the building. In cross-sectional view, the load-beating panels define a U-shape. A pair of flanges are disposed vertically on the side edges of the panel. The flanges constitute support columns for carrying the weight of the roof of the building. The space between the flanges is used for a pipe chase, air duct, recess for a sink unit, shelf space or insulation. As with standard construction, the space may also be covered by attaching interior wall panels to the free ends of the flanges. The load-bearing panels are positioned on the foundation on a steel angle embedded in the footing. A portion of the footing projects upward. A bolt also extends upward from the footing. The bottom front edge of the panel is welded to the portion extending upwardly from the footing. The back of the panel receives the bolt. A levelling nut is turned on the bolt to level the panel and is secured by welding the nut on the bolt. The in-fill panels are precast of reinforced concrete and preferably contain the window and door openings. The in-fill panels are positioned between and secured to a pair of load-bearing panels.

U.S. Pat. No. 4,842,669 issued to Considine describes a structural wall panel and method of assembly of such a panel. The panel includes a rigid insulating material to which studs and an exterior wafer board panel are bonded. The panels are manufactured by applying an adhesive to the wafer board panel, positioning the wafer board panel on top of a stud wall, and pressing the wafer board panel into the stud wall for a pre-determined time to secure the wafer board panel to the stud wall.

U.S. Pat. No. 4,481,743 issued to Jellen describes a construction method that erects pre-formed panels on a foundation of the building. The panels are mounted on carrier assemblies that travel in a track around the exterior of the foundation. Once the panels are in position, leveling bolts in the base of the panel are backed out to engage the upper surface of the track. Cementitious material is poured around the track and the base of the panel to firmly lock the panels and their supporting carrier assemblies into place.

Such known modular panels and systems for installing modular panels have drawbacks which reduce the benefits that are expected from modular construction techniques. These drawbacks include low insulative characteristics of the panels, construction time and labor that decreases the advantages of modular construction, complications with assembly of the panels into a wall, and panels that are not readily adapted to include window and door openings. For some panels, insufficient insulative properties of the assembled panel requires on-site addition of insulation. This additional labor and expense at a job site is eliminated by a modular panel designed with improved insulative characteristics.

For some modular panels, construction assembly is time consuming and labor intensive. Special connecting and leveling members are included in the panels, thereby increasing the cost and complexity of the panels. The modular panel should reduce overall labor and construction time to reduce the cost of the building construction.

Related to this is on-site assembly of the panels into an exterior wall. Some panels have complicated interlocking flanges and support frames. These complicated assemblies are labor intensive to align the panels, level the panels, and join the panels together and to the foundation. Some wall panels made substantially entirely of concrete are heavy and require cranes to lift and move the panels.

Some known modular buildings have windowless exterior walls. As discussed above, it is known to provide an in-fill panel to accommodate windows and doors. The modular panel should easily be adaptable to accommodating windows and doors. This will provide flexibility in designing office buildings and houses using these modular panels.

Accordingly, there exists a need in the art for a modular panel for assembling exterior walls that has improved insulative characteristics, reduces labor and time to manufacture, is readily and easily assembled, and accommodates placement of windows and doors.

SUMMARY OF THE INVENTION

The present invention provides a preformed modular panel for constructing a wall of a building and provides a method of assembling such panels. Generally described, the panel comprises a rigid frame, a sheet of exterior finishing material, and a sheet of insulating material. The sheet of exterior finishing material attaches to an exterior periphery of the frame. The sheet of insulating material inserts into the frame intermediate an interior periphery and the exterior periphery of the frame. The insulating sheet is spaced apart from the sheet of exterior finishing material to define a dead-air space between the sheet of insulating material and the sheet of exterior finishing material.

More particularly described, the panel comprises a rectangular frame made of interconnected members. At least two opposing members each include a slot parallel to the longitudinal axis of the member. The slot is spaced intermediate an exterior edge and an interior edge of the member. The sheet of insulating material slidably inserts in the frame intermediate the interior and the exterior peripheries. The slots in the members of the frame receive the edges of the sheet. A sheet of exterior finishing material attaches to the frame at the exterior periphery of the members. The exterior sheet is thereby spaced apart from the sheet of insulating material to define a dead-air space between the sheets.

More particularly described, the frame comprises two parallel, spaced apart side members, a top plate, and a bottom plate. The top plate and the bottom plate connect to the side members to form a rectangle. The bottom plate rests on top of the foundation when a wall is built using the completed wall panel. In a preferred embodiment, the bottom plate is spaced up from the bottom edge of the exterior sheet to define a footer portion of the panel. The footer portion abuts a side of the foundation when the completed wall panel is joined together with other such panels to form a wall of a building. In another embodiment, the bottom plate aligns with a bottom edge of the sheet of exterior finishing material.

An alternate embodiment of the present invention includes at least one intermediate member disposed parallel to and between the side members. The top plate and the bottom plate rigidly connect to the intermediate member. The frame may readily be adapted to include door jambs and window sills by the addition of appropriate cross members connected on the interior of the frame.

The insulating sheet may be a foam sheet positioned in the frame during assembly. In a preferred embodiment the opposing side members, the top plate, and the bottom plate include longitudinal slots. The slots are uniformly spaced apart from the periphery of the side members and the plates. The slots receive the edges of the foam sheet. The sheet first slides along the slots of the side members into the slot of the top plate. The bottom edge of the foam material inserts into the slot in the bottom plate as the plate is added to the frame. The foam sheet in the frame cooperates with the exterior skin to define a dead air space.

In a preferred embodiment, the sheet of exterior material is a skin of solidified cementitious material. A plurality of projections extend outwardly from the exterior side of the frame. During manufacture, the frame is positioned so that the projections extend down into fluidal cementitious material held in a casting form. The fluidal cementitious material cures around the projections into a solidified skin, with the projections anchoring the cementitious skin to the frame. In an alternate embodiment, the sheet of exterior material may be an exterior grade of siding. The siding is first positioned on the exterior periphery of the frame. Second, the projections, such as nails, screws, and the like, are driven through the siding and the insulating sheet into the members of the frame for attaching the siding to the frame.

The present invention further provides a method of assembling a wall panel for modular building construction. Generally described, the method comprises placing in a frame a sheet of insulating material intermediate an exterior periphery and an interior periphery of the frame and attaching a sheet of exterior finishing material to the exterior periphery. The sheets of insulating material and exterior finishing material are thereby spaced apart and define a dead-air space. The dead-air space provides the wall panel with increased insulative characteristics.

More particularly described, the method of assembling the wall panel includes inserting the edges of the sheet of insulating material into slots formed in the members of the frame. The slots in the members extend parallel to the longitudinal axis of the members and intermediate an exterior edge and an interior edge. The frame is preferably first partially assembled into a U-shape having a top plate and two side members. The sheet of insulating material slides into the partially formed frame. After positioning the sheet of insulating material in the frame, the bottom plate connects to the respective ends of the two side members, and the slot in the bottom plate receives the edge of the sheet of insulating material. The sheet of exterior skin attaches to the exterior periphery of the frame to complete the wall panel.

In the embodiment having an exterior sheet of the cementitious material, a plurality of projections, such as nails, extend outwardly from the frame. The frame is inverted to position the projections down into the fluidal cementitious material contained in a casting form. The cementitious material receives and surrounds the projections, and cures into the solidified skin with the projections anchoring the cementitious material to the frame.

Completed wall panels are stacked and transported to a construction site for a building. The foundation for the building preferably is a concrete slab having a height above grade at least equal to the height of the footer portion of the panels. The panels can also be used for buildings have wood joists and floors supported by cement block footings or poured foundations. An erector cart transports and handles the modular wall panels during assembly of the wall. The wall panel is pulled from a stack of panels with a wench and placed on the cart, and with a shoe on the cart supporting the frame from below the bottom plate, the cart is moved to the edge of the building. The wall panel is elevated by a hydraulic cylinder on the cart into a near vertical position with the bottom plate resting on the slab or floor and the footer portion overhanging the edge of the slab. Rocking the wall panel forward permits the shoe of the can to be withdrawn from beneath the bottom plate. The panel is then slid laterally sideways until it contacts the adjacent panel and is vertically aligned therewith. The installed panel may then be secured to the slab and to the adjacent wall panels.

The present invention thereby provides a wall panel with improved insulative characteristics for constructing the exterior walls of a modular building and a structural wall formed from a plurality of such panels. The present invention provides a method for rapidly assembling such modular wall panels. Further, the wall panel of the present invention readily adapts to positioning windows and doorways in the modular panel.

Accordingly, it is an object of the present invention to provide a modular building panel.

It is another object of the present invention to provide a modular building panel that is easily constructed.

It is another object of the present invention to provide a modular building panel that during assembly may easily be modified to accommodate window and door openings.

It is another object of the present invention to provide a modular building panel with improved insulative characteristics.

It is another object of the present invention to provide a modular building panel that economically defines a dead-air space for insulation purposes.

It is another object of the present invention to provide a modular building panel that readily receives an exterior skin.

It is another object of the present invention to provide a modular building panel that reduces the materials and construction costs for a building.

It is another object of the present invention to provide a modular building panel that is economically competitive with conventional construction techniques for buildings.

It is another object of the present invention to provide a modular building panel that increases the energy efficiency of the building over conventional buildings.

It is another object of the present invention to provide a modular building panel and assembly system that reduces the time required to assemble a weather-tight shell for a building as compared with conventional construction.

It is another object of the present invention to provide a modular building panel that reduces routine maintenance over the life of the building.

It is another object of the present invention to provide an improved wall assembled from a plurality of novel modular panels.

Still other objects, features and advantages of the present invention will become apparent upon a reading of the following detailed description in conjunction with the drawings and the appended claims.

BRIEF DESCRIPTION OF THE DRAWINGS

FIG. 4*d* is a partial cut-away perspective view of the casting form illustrated in FIG. 4*a*.

FIG. 4*e* is a cut-away end view of the casting form illustrated in FIG. 4*a*.

FIG. 5 is a side view of a conveyor frame for receiving and conveying the casting form illustrated in FIG. 4*a*.

FIG. 6*c* is a perspective view of a portion of the elevator illustrated in FIG. 6*a*.

FIG. 9*c* is a partial perspective view of the transfer cart illustrated in FIG. 9*a*.

FIG. 12*a* is an exploded end view of the casting form shown in FIG. 4*a* and a squaring jig that aligns the frame of the wall panel with the casting form.

FIG. 12*b* is a side view of the squaring jigs that align the frame and the casting form.

.

DETAILED DESCRIPTION OF THE DISCLOSED EMBODIMENTS

Figure 1:
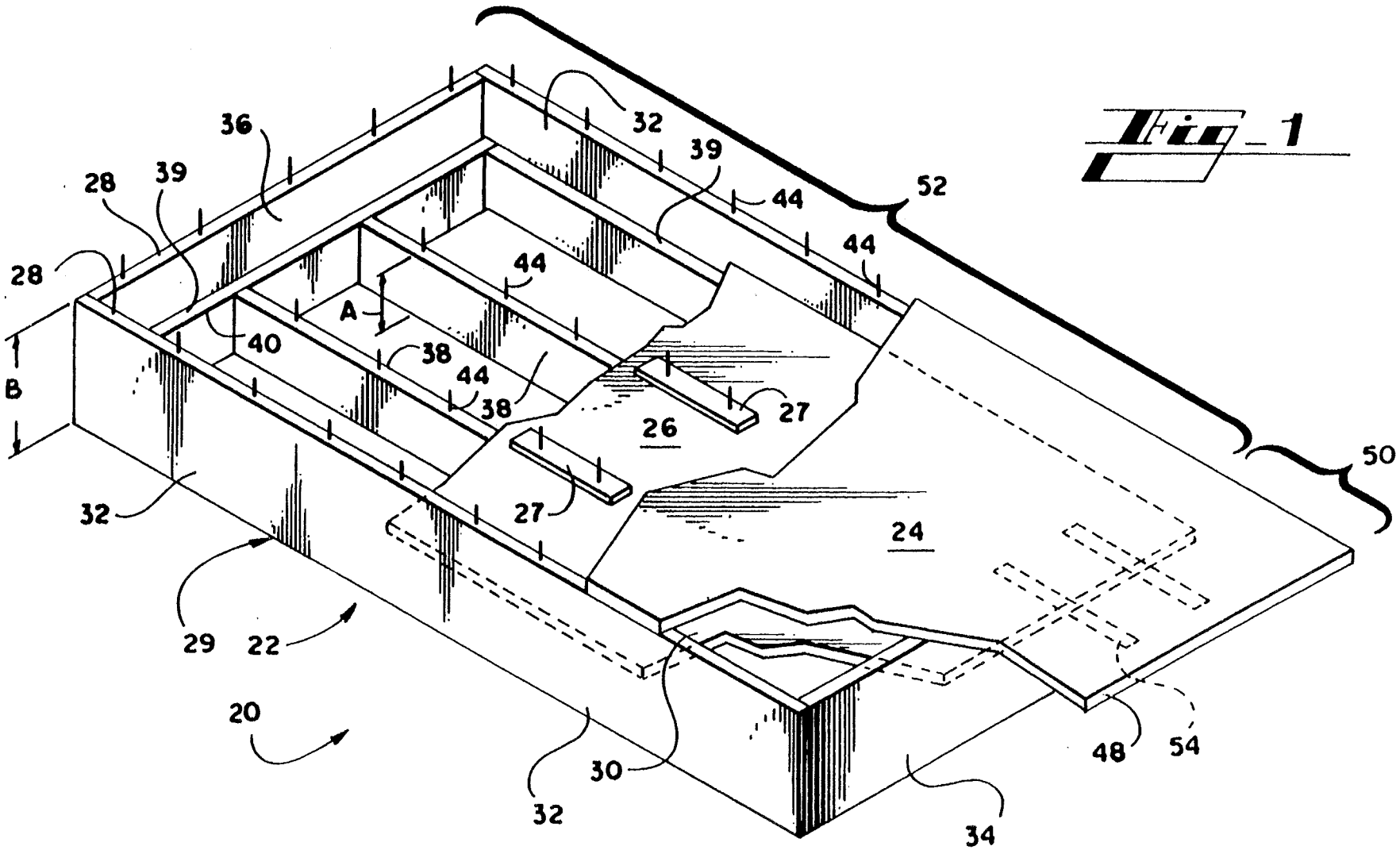
FIG. 1 is a perspective view of a modular wall panel constructed in accordance with a preferred embodiment of the present invention, with portions cut away to reveal interior detail.

Referring now in more detail to the drawings, in which like numerals indicate like parts throughout the several views, FIG. 1 illustrates a perspective view of a pre-formed modular wall panel 20 constructed in accordance with a preferred embodiment of the present invention. A plurality of the wall panels 20 join together to form an exterior wall of a building. In FIG. 1, a portion of the wall panel 20 is cut-away to reveal interior detail. The wall panel 20 includes a frame 22 that supports an exterior sheet 24 of finishing material and an insulating sheet 26 on the interior of the frame. The exterior sheet 24 attaches to an exterior periphery 28 of the frame 22. The insulating sheet 26 is disposed intermediate an interior periphery 29 and the exterior periphery 28 of the frame 22 and accordingly is spaced apart from the exterior sheet 24. This spaced-apart relationship defines a dead-air space 30 between the exterior sheet 24 and the insulating sheet 26. The dead-air space 30 increases the insulating characteristics of the panel 20.

More particularly described, the frame 22 comprises a pair of parallel side members 32 joined to a bottom plate 34 and a top plate 36 at the respective ends. The panel 20 in the illustrated embodiment also includes a pair of spaced-apart intermediate members 38 disposed parallel to the side members 32. The intermediate members 38 connect at their ends to the bottom plate 34 and the top plate 36. The depth A of the intermediate members 38 is less than depth B of the side members 32, the bottom plate 34, and the top plate 36. The side members 32, the bottom plate 34, and the top plate 36 each include a longitudinal slot 39 in the respective interior surface. The slot 39 in each of the side members 32, the bottom plate 34 and the top plate 36 is intermediate the interior periphery 29 and the exterior periphery 28 of the frame 22. The slot 39 is accordingly spaced apart from the exterior periphery 28 of the frame 22, and has a depth sized to receive an edge of the insulating sheet 26. In a view from the exterior periphery 28, the slot 39 is positioned so that a bottom edge 40 of the slot is no lower than the exterior facing edge of the intermediate members 38.

The insulating sheet 26 of the panel 20 is preferably a foam sheet and is preferably a dense-packed polystyrene material having insulative properties. The insulating sheet 26 is supported in the frame 22 by inserting the edges of the insulating sheet into the slots 39 of the side members 32, the bottom plate 34, and the top plate 36. The insulating sheet 26 cooperates with the exterior sheet 24 and the members of the frame 22 to define the dead-air space 30. Engagement of the edges of the insulating sheet 24 in the slots 39 forms a closed air space in cooperation with the exterior sheet 24, thereby providing increased insulative characteristics for the modular wall panel 20. The dead-air space 30 preferably has a depth of about one to two inches. A plurality of blocks 27 can be disposed on the insulating sheet 26 to space it from the exterior sheet 24 and to prevent the insulating sheet from partially dividing the dead-air space 30. This occurs on occasion when the insulation sheet is pushed outwardly while insulation material is being attached to the interior side of the frame 22 after the wall panel is joined to others to form a wall.

A plurality of projections 44 extend outwardly from the exterior periphery 28 of the panel 20. The projections 44 are spaced apart and extend outwardly from the side members 32, the bottom plate 34, the top plate 36 and the intermediate members 38. The projections 44 engage and attach the exterior sheet 24 to the frame 22. The projections 44 preferably are nails, such as a three and one quarter inch galvanized screw shank nail. The nails in the intermediate members 38 are driven through the insulating sheet 26. In one embodiment of the invention (not illustrated), the exterior sheet 24 is a hardboard sheet positioned on the exterior periphery 28 of the frame 22. A plurality of the nails are driven through the hardboard sheet to secure the hardboard sheet to the frame 22. In a preferred embodiment of the modular panel 20, the exterior sheet 24 is a cementitious sheet with a depth of between about one and a half inches and two and one half inches. The nails are driven into the frame 22 with a portion of each nail extending outwardly from the exterior periphery 28 a distance calculated to have the head of the nail within the exterior sheet 24. The projections 44 embed in the exterior sheet 24 by inverting the frame 22 so the projections extend downward into a casting form containing a fluidal cementitious material. The cementitious material is cured and the embedded projections 44 seem the solidified cementitious sheet to the frame 22.

As illustrated in FIG. 1, the bottom plate 34 is spaced apart from a lower edge 48 of the exterior sheet 24 to define a footer portion generally designated 50 extending as a cantilever from a wall portion 52 of the panel 20. The embodiment of the wall panel having the cementitious exterior sheet also includes a plurality of reinforcement bars 54 embedded in the footer portion 50 and extend into the wall portion 52 of the sheet. Two of the reinforcement bars 54 are illustrated in phantom in FIG. 1. The bars 54 are spaced apart and are disposed parallel to the longitudinal axis of the wall panel 20. In an alternate embodiment, the bottom plate 34 is aligned with the lower edge 48. The concrete exterior skin may be further reinforced by adding fiber reinforcement during mixing of the cementitious fluidal material. One such reinforcement fiber is FIBERMESH fiber available from Fibermesh Company of Chattanooga, Tenn.

In a preferred embodiment of the panel 20, the side members 32, the bottom plate 34, the top plate 36, and the intermediate members 38 are made of pressure treated wood boards. The side members 32 and the plates 34 and 36 are made of two by six boards. The intermediate members 38 are made of two by four boards. In an alternate embodiment (not illustrated) the side members and the plates are metal studs with U-channels attached to the sides for receiving the edges of the insulating sheet.

Figure 2:
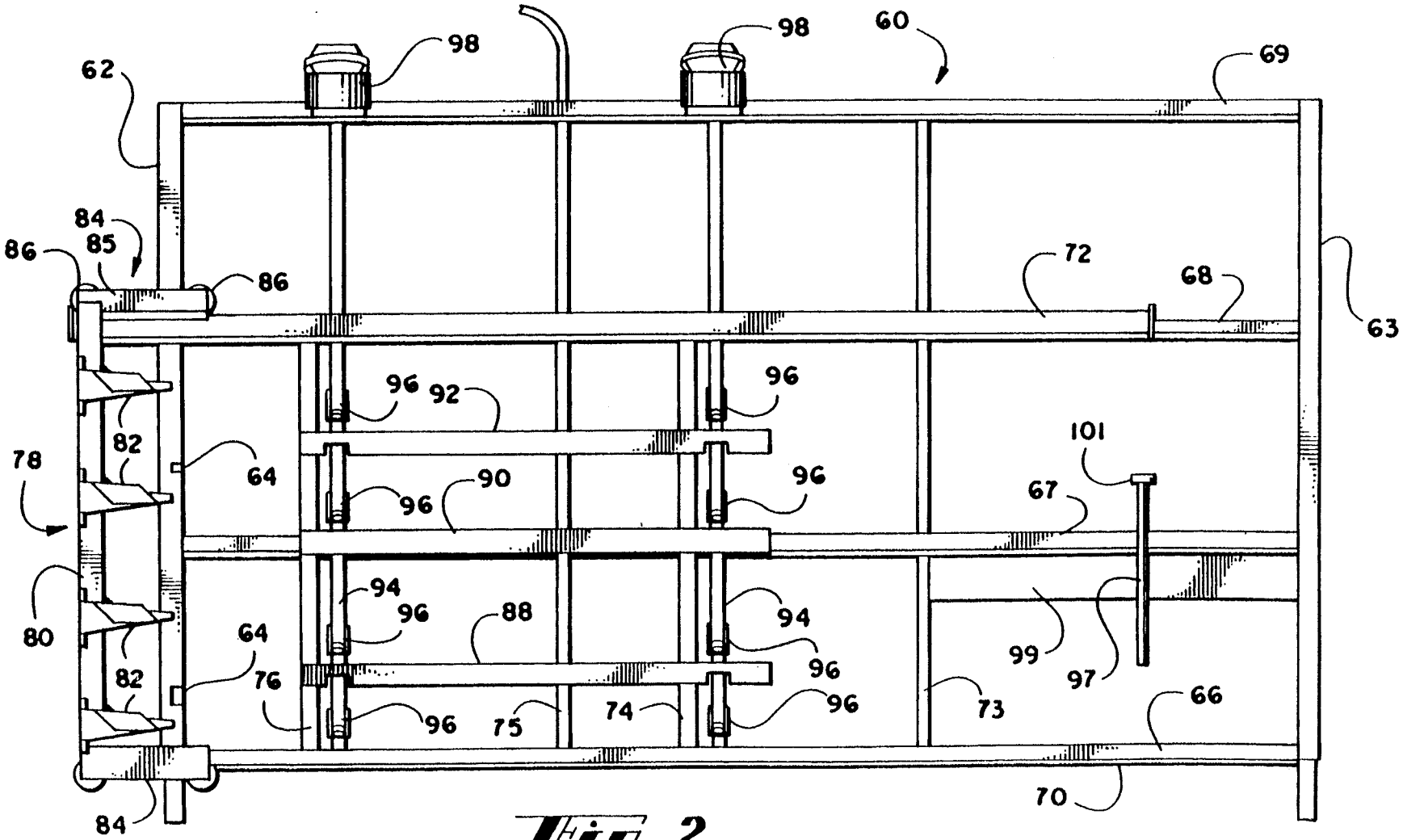
FIG. 2 is a front view of a jig for assembling the frame for the wall panel illustrated in FIG. 1.

FIG. 2 illustrates a front view of a jig 60 for assembling the frame 22 discussed above. The jig 60 preferably stands at an incline so the members of the frame 22 lay upon it while being accessible to a person in a standing position during assembly of the frame. The jig 60 includes side legs 62 and 63, with a pair of stops 64 extending laterally from the side leg 62. The stops 64 provide a backing to hold the top plate 36 during assembly of the frame 22. Four transverse beams 66, 67, 68, and 69 connect to the side legs 62 and 63. The beam 66 supports a V-shaped track member 70 pointed downward and the beam 68 supports a V-shaped track member 72 pointed upward. The upper beam 69 supports a pair of air chambers 98 that are operable to raise and lower rubber shoes for rigidly holding the members of the frame 22 during assembly, as discussed below. The air chambers 98 connect to a supply of compressed air. Four vertical braces 73, 74, 75, and 76 connect to the transverse beams 64, 65, 66 and 67 to provide rigidity and strength to the jig 60.

The jig 60 includes a moveable traversing frame 78 having a support beam 80 with four nail gun stations 82 and a pair of trolleys 84. Two of the nail gun stations align with the intermediate members 38 which are covered by the insulating sheet 26, best illustrated in FIG. 1. Each trolley 84 comprises an arm 85 on which is mounted a pair of V-groove wheels 86. The wheels 86 engage and travel on the track members 70 and 72.

Three horizontal bars 88, 90, and 92 connect to the braces 74, 75 and 76. The beam 66 and the bars 88, 90 and 92 are L-shaped in cross-section, so each has an outwardly extending horizontal shelf. A member of the frame 22 lies on each of the shelves during assembly. A pair of clamp rails 94 extend perpendicularly between the beams 66 and 69 adjacent the bars 88, 90, and 92 and each clamp rail connects at an upper end to an actuator rod extending from one of the air chambers 98. Four clamp shoes 96 connect to each clamp rail 94, and each clamp shoe is spaced vertically above a respective one of the beam 66 and the bars 88, 90, and 92. Each clamp shoe 96 comprises a rubber shoe attached to a pair of gusset plates that connect to and extend laterally from the clamp rail 94. In the illustrated embodiment, the clamp rail 94 is a U-channel with inwardly directed flanges. The gusset plates are disposed on the sides of the channel. A back plate connects to the gussets across the open back side of the U-channel. An inside plate is held against the inwardly directed flanges on the interior of the U-channel with a bolt extending through the back plate and threaded into a tapped hole in the inside plate. The bolt rigidly connects the clamp shoe 96 to the rail 94 and the clamp shoes 96 are thereby selectively positioned over the beam 66 and the bars 88, 90 and 92. An end clamp 100 pivotally connects at a joint 97 to a plate 99 which is horizontally disposed and attached to the leg 63 and the brace 73. The clamp shoes 96 and the end clamp 100 hold the members and the plates of the frame 22 during assembly of the frame. The jig 60 is adjustable to facilitate production of panels of various lengths. For instance, the bars 88, 90, and 92 are bolted to the rails 74 and 76 at predetermined pre-drilled holes to accommodate the frame of the illustrated embodiment. These bars may be moved or removed to accommodate other frame structures. The clamp 100 may also be repositioned laterally to a different pivot joint to accommodate various lengths for the frame 27.

To assemble the frame 22 illustrated in FIG. 1, the top plate 36 is positioned against the stops 64 on the leg 62. The pair of side members 32 are placed on the lateral shelves of the beam 66 and the bar 92. The pair of intermediate members 38 are placed on the lateral shelves of the bars 88 and 90. The ends of the horizontally disposed members 32 and 38 are butted up against the vertically disposed top plate 36. Then the air chambers 98 are operated to extend the actuator rod from the air chamber. This moves the clamp rails 94 downward and thereby presses the rubber shoes against the sides of the frame members 32 and 38 to forcibly hold them against the shelves of the bars 66, 88, 90, and 92. The clamp shoes 96 prevent the side members 32 and the intermediate members 38 from moving while the frame 22 is assembled and nailed rigidly together. The insulating sheet 26 of foam material is next slidably inserted into the longitudinal slots 39 of the side members 32 in the partially complete frame 22. The insulating sheet 26 rests on the upper surface of the intermediate members 38. In an alternate embodiment, not illustrated, the side members 32 may include a trim board on the inside surface instead of the slot 39. The insulating sheet 26 then rests on and is secured to the trim boards by gluing, nailing, or other such means.

The top edge of the insulating sheet 26 is inserted into the slot 39 of the top plate 36. The bottom plate 34 is then positioned against the ends of the side members 32 and the intermediate members 38. The slot 39 in the bottom plate 34 receives the free edge of the insulating sheet 26. The end clamp 100 is pivoted at its joint 97 from a first position parallel to the side leg 63 to a second position parallel to the transverse beam 67. A first end 101 of the clamp 100 bears against the exterior side of the bottom plate 34. The clamp 100 thereby pushes the bottom plate 34 tightly against the side members 32 and the intermediate members 38. The top plate 36 and the bottom plate 34 are then nailed to the ends of the side members 32 and the intermediate members 38.

To provide the projections 44 in the frame 22, a nail gun is positioned in one of the nail gun stations 82. The nail gun is preferably air-actuated to facilitate positioning the projections 44 in the frame 22. The traversing frame 78 is rolled laterally across the frame 22 with the wheels 86 of the traversing frame 78 traveling on the V-shaped track members 70 and 72. The travelling frame 78 is stopped periodically and the nail gun operated to drive nails into the frame members 32 and 38 at spaced intervals. When the travelling frame 78 reaches the opposite end of the frame 22, the nail gun is removed and positioned in another of the nail gun stations 82. The travel of traversing frame 78 is then reversed. The traversing frame 78 is again stopped at intervals and the nail gun activated to drive nails into the frame 22. The nail gun is positioned at each nail station 82 and the traversing frame moved laterally across the jig 60 and stopped periodically in order to operate the nail gun for placing the projections 44 in the frame 22.

In an especially preferred embodiment, the exterior sheet 24 is a cementitious sheet. A spacer (not illustrated) is preferably used with the nail gun to assure that the head of the nails are disposed outwardly from the frame 22 a distance calculated to place the heads within the cementitious exterior sheet 24. The spacer is manually held in place between the nail gun and the insulating sheet 26 in the frame 22. The barrel of the nail gun is extended through a bore in the spacer for firing nails through the insulating sheet 26 into the members of the frame 22. The completed frame 22 is then removed from the jig 60 and stacked with other frames 22 for transport to an assembly area for attaching a cementitious exterior skin. In an alternate embodiment, the exterior sheet 24 is a hardboard sheet, such as MASONITE paneling or the like. In this alternate embodiment, the hardboard sheet is positioned on the exterior periphery 28 of the frame 22 prior to nailing. The nails secure the hardboard sheet to the exterior periphery 28 of frame 22. The panels with the hardboard sheet exterior are stacked for transport to a construction site.

In the preferred embodiment, the cementitious exterior sheet 24 is then attached to the frame 22. The modular panel 20 having the cementitious exterior sheet 24 preferably is manufactured on an assembly line 120 illustrated in a top schematic view in FIG. 3. The assembly line 120 includes apparatus that facilitates handling of the panels 20 which may be quite large and heavy. A preferred size of the panel 20 is about four feet wide by nine feet high. The width of about four feet is a multiple of the sixteen and twenty-four inch offsets for wall studs found in typical building construction. The height of about nine feet provides a footer 50 of twelve inches and a standard wail of about eight feet between the floor and the ceiling.

Figure 3:
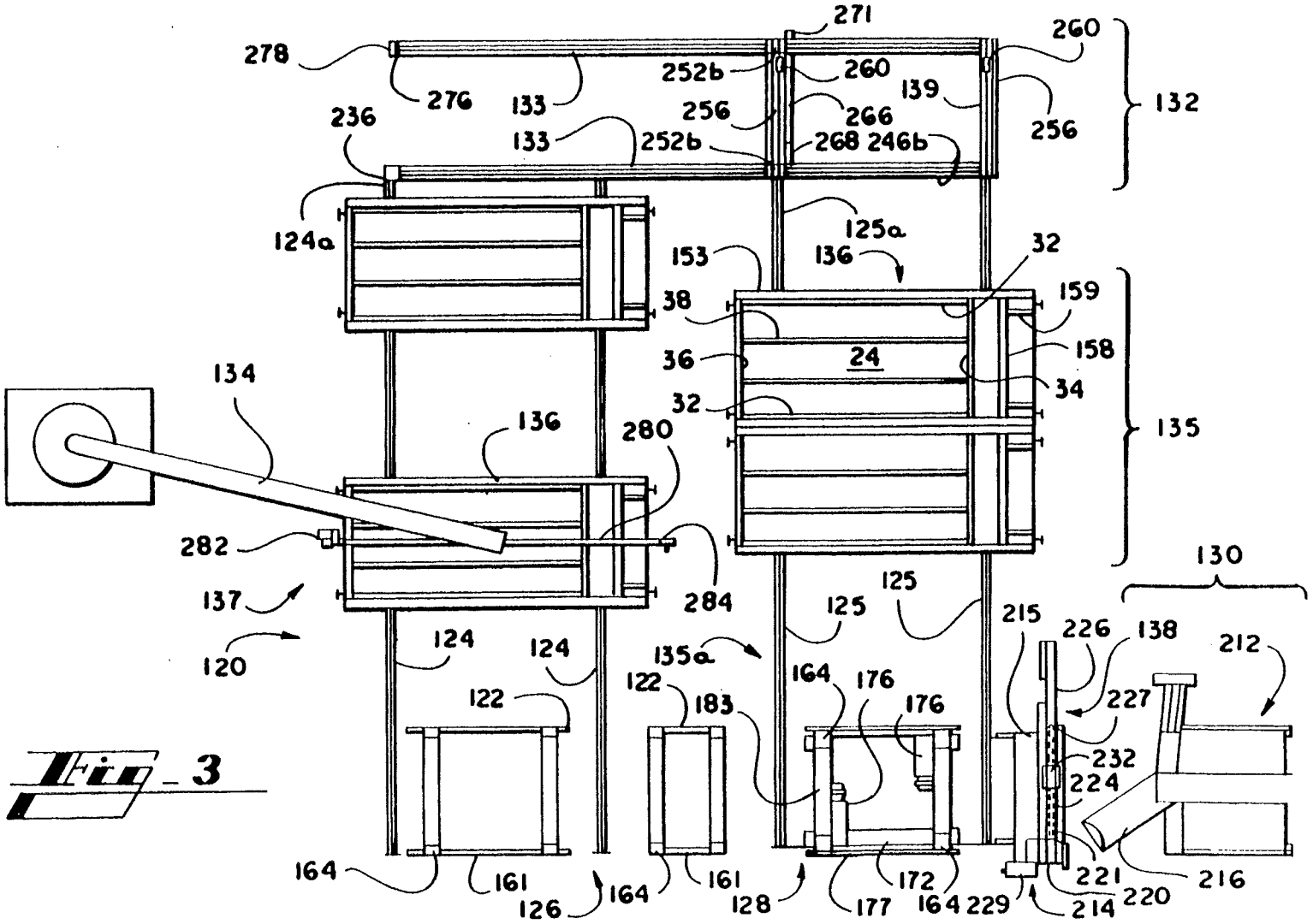
FIG. 3 is a plan view of an assembly line for constructing the wall panel illustrated in FIG. 1 having a preferred cementitious exterior sheet.

Briefly, the closed-loop assembly line 120 illustrated in FIG. 3 comprises a pair of roller conveyors 122 in a staging area 126 and two sets of parallel guiderails 124 and 125 that carry a casting form 136 through a curing area 135 and a discharge area 137, respectively. An elevator 128 between the staging area 126 and a cement pouring area 130 transfers the filled casting form 136 to the guiderails 125 in the curing area 135. A crane 134 in the discharge area 137 of the assembly line 120 removes the completed modular wall panel 20 from the guiderails 124. In use of the assembly line 120 as shown, the panels 20 are moved manually along the guiderails.

Generally described, the casting form 136, discussed below, for the cementitious exterior sheet 24 is received by the roller conveyor 122 in the staging area 126. The casting form 136 is moved across the elevator 128, which is in a raised position, to the cement pouring area 130. A predetermined volume of fluidal cementitious material is poured into the casting form 136. As the casting form 136 is returned to the elevator 128, it passes under a vibrating screed 138 to assist leveling the cementitious material in the form 136. One of the frames 22 described above is positioned on the casting form 130 with the projections 44 extending downwardly into the layer of fluidal cementitious material.

The elevator 128 is then lowered to place the casting form 136 on the guiderails 125 for traveling through the curing area 135. The casting form 136 is moved laterally on the guiderails 125 to a first position **135*a* immediately adjacent the elevator 128. A squaring jig (discussed below) is placed on the frame 22 to align the frame with the casting form 136 while the cementitious material cures. In the preferred embodiment, the squaring jig remains on the frame 22 until the next panel has been produced and is ready to move into the position 135*a*. However, the squaring jig is not removed until the cementitious material is cured sufficiently so the projections 44 hold the solidified cement skin to the frame 22** and depending on the cure rate of the cement, a plurality of squaring rigs may be required so one accompanies each casting form into the discharge area.

Each of the casting forms 136 is sequentially moved from the curing area 135 onto a transfer cart 139 in the transfer area 132. The transfer cart 139 travels on the guiderails 133 to move the casting form 136 from the curing area 135 to the discharge area 137. In the discharge area 137, the crane 134 is connected to the casting form 136 in which the cementitious material has cured to form the solidified exterior sheet 28. The crane 134 includes a roll-over truss (discussed below) for lifting the casting form 136 including the wall panel 20 from the guiderails 124 and rotating the panel 180° before setting the panel on a stack (not illustrated) of completed panels 20. The panel 20 is released from the casting form 136 which is then transferred to the staging area 126 to begin the manufacturing process again.

FIGS. **4*a*, 4*b* and 4*c* illustrate the casting form 136 in top view, side view, and end view, respectively. FIG. 4*d* is a cut-away partial perspective view of the casting form 136. FIG. 4*e* is a cut-away end view of the casting form 136. The casting form 136 comprises four U-channels 140 connected together at the longitudinal ends to define the rectangular shape of the illustrated modular panel 20. Each of the U-channels 140 faces inwardly with the side flanges 141 disposed horizontally. The two U-channels 140 defining the ends of the casting form 136 each include an opening 142 in the side-facing base of the "U." The opening 142*a* in one end U-channel 140 is rectangular while the opening 142*b* in the opposite end U-channel is circular. The openings 142 receive pins extending from a support truss (discussed below) that is carried by the crane 134 in order to lift, roll over and move the finished wall panel 20 from the guiderails 124 in the discharge area 137**.

At least two bolts 143 extend outwardly from the outside surface of the U-channels 140 below the midpoint of the channels. As best shown in FIG. **4*e*, the bolts 143 extend through holes in the U-channels 140 so that the bolt heads 111 are inside the casting form 136. The bolt heads 111 are welded to the U-channel 140 to secure the bolts 143 to the casting form 136. A plurality of bolts 143*a* similarly attach to and protrude from the U-channels 140 near the upper edge. The bolts 143 and 143*a* cooperate to align and attach a rail 144 to each of the U-channels 140**.

Four rails 144 releasably attach to the U-channels 140 that define the two sides and the two ends of the casting form 136. The rails 144 include a plurality of large openings 146 and at least two small openings 147 spaced apart in correspondence with the bolts **143*a* and 143**.

The diameter of large openings 146 preferably are larger than the diameter of the bolts 143, with tolerance to allow the rail 144 to have lateral movement on the bolts 143*a*, for stripping as discussed below. The diameter of the small opening 147 is preferably smaller than the diameter of the larger opening 146.

The rails 144 attach to the U-channels 140 by sliding the respective openings 146 and 147 over the outwardly extending bolts 143*a* and 143. A wing nut 149 threads on each of the bolts 143*a* passing through a large opening 146. The wing nuts 149 tighten down to hold the rails 144 against the casting form 136. The small openings 147 cooperate with the bolts 143 to align the rail 144 on the U-channel 140 and to prevent the rail 144 from sliding up and down. The larger openings 146 have a loose fit with the bolts 143*a* to facilitate breaking the rails 144 away from the cementitious skin after curing so the panel 20 may be removed from the casting form 136. As necessary, shims may be inserted between the U-channel 140 and the rail 144. For example, the casting form 136 is preferably smaller than the desired final width of the panel 20. In the embodiment illustrated in FIG. 1 with a four foot wide panel, the shims adjust the width of the casting form 136 to a desired width such as $47\frac{7}{8}$ inches. This accommodates placement of caulk between adjacent panels and for tolerance on placing the panels during assembly of the building.

With reference to FIGS. 4*d* and 4*e*, a plywood sheet 150 attaches to the upper surface of the upper flange 141. A concrete form liner 151 lies on the plywood sheet 150. In a preferred embodiment, the form liner 151 is bonded permanently to the plywood sheet 150. This reduces the shrinkage of the form liner 151 during use. It is preferred that an ELASTO-TEX form liner available from Symons Corporation in Des Plaines, Illinois be used, although other form liners are available. These include the DESIGN-PLUS form liners manufactured by Scott Company of Denver, Colo.

The rails 144 define upstanding walls around the edge of the form liner 151. Each rail 144 includes a bevel overhang 152 along an upper edge that is spaced upwardly of the liner 151 and that extends inwardly and over the form liner. The rails 144 and the plywood sheet 150 with the form liner 151 define a cavity 148 for receiving fluidal cementitious material, as best viewed in FIG. 4*e*. An L-shape stiffener 153 (best illustrated in FIGS. 4*a* and 4*e*) attaches along the upper edge of the outside face of each of the rails 144*a* and 144*b* on the sides of the casting form 136. The stiffener 153 increases the rigidity of these rails 144*a* and 144*b* on the sides to resist the lateral outward pressure of the cementitious material that is poured into the casting form 136 during manufacture of the panel 20. In a preferred embodiment, both of the stiffeners 153 include two spaced-apart holes 145 for a purpose discussed below.

The left and the right sides of the casting form 136 in FIG. 4*e* illustrate the two positions for the mils 144 as discussed above.

The wing nut 149*a* tightens on the bolt 143 to firmly hold the rail 144*a* against the U-channel 140, as shown on the left side of the casting form 136. With the rails 144 held against the U-channels, fluidal cementitious material is poured into the cavity 148 and cured. In the second position as shown on the fight side of the casting form 136, the rails 144 break away from the U-channels 140 after curing. The wing nut 149*b* is loosened on the bolt 143. The rail 144 breaks away from the U-channel 140 and from the solidified cementitious material in the cavity 148. The completed panel 20 is then removed from the casting form 136.

Figures 4A, 4B, 4C:
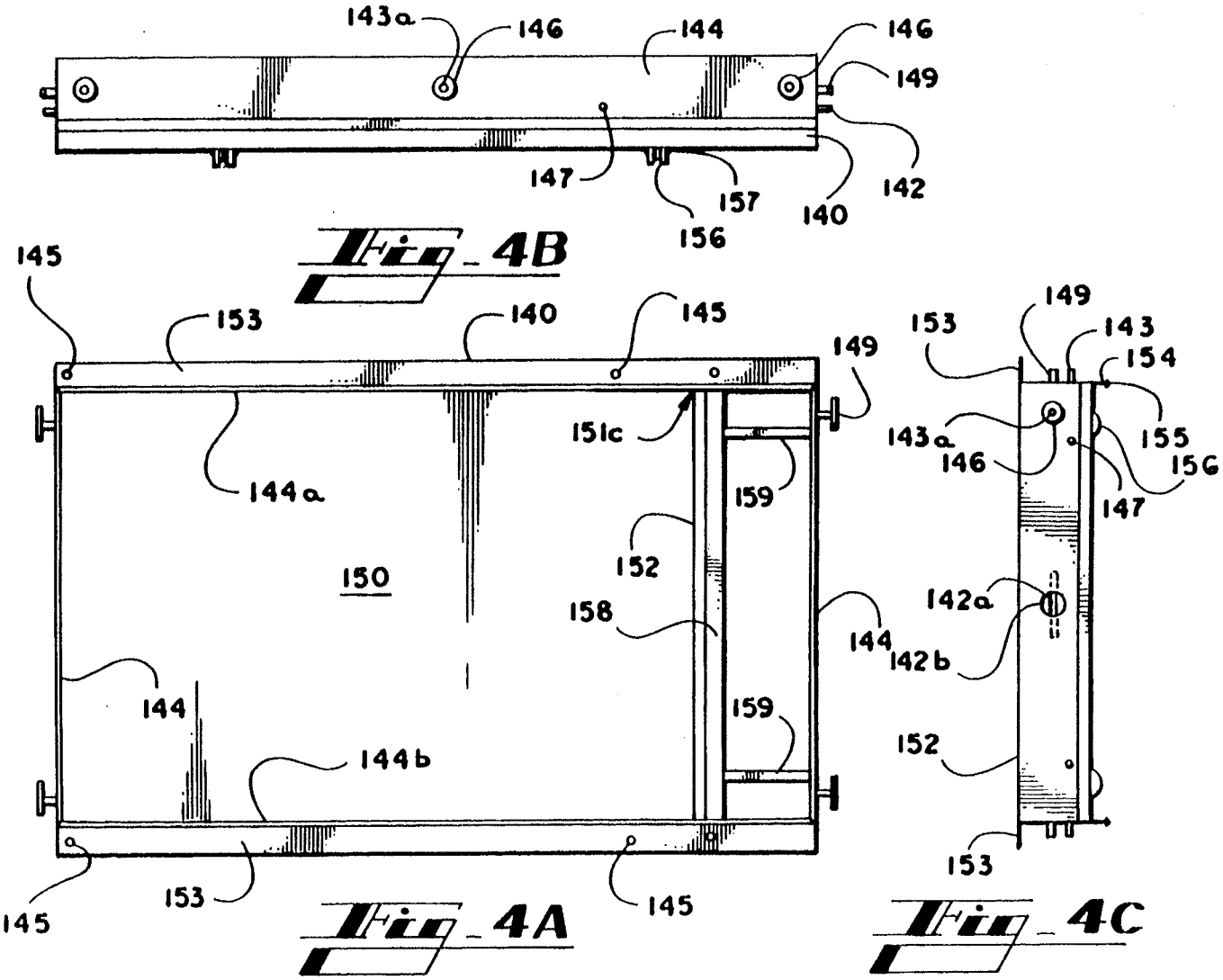
FIG. 4*a* is a top plan view of a casting form for pouring and curing a cementitious exterior sheet for the wall panel illustrated in FIG. 1.
FIG. 4*b* is a side view of the casting form illustrated in FIG. 4*a*.
FIG. 4*c* is an end view of the casting form illustrated in FIG. 4*a*.

With reference to FIGS. 4*c*, 4*d*, and 4*e*, a pair of angle members 154 connect to the bottom of the casting form 136 along the sides parallel to the longitudinal axis. Each member 154 extends downward and terminates in a V-shape rail 155. The rails 155 travel in V-groove wheels on stanchions in the assembly line 120 to move the casting form 136 during manufacturing of the panel 20. However, as shown in FIG. 3, the casting form 136 not only is moved left to fight from the staging area 126 to the cement pouring area 130, it also is moved front to back through the curing area 135 and the discharge area 137. To provide for this second direction of travel, the bottom of the casting from 136 includes a V-groove wheel 156 near each of the four comers of the casting form. Each wheel 156 freely rotates on a pin connected between a pair of flanges 157 on the interior of the casting form. The flanges 157 rigidly connect at a perpendicular angle to the side U-channels 140.

As illustrated in FIG. 4*a*, a bulkhead 158 removably inserts into the cavity 148 and is disposed transverse to the longitudinal axis of the casting form 136. A pair of braces 159 extend between a back side of the bulkhead 158 and the inside surface of the end rail 144. During manufacture of the panel 20, the bulkhead 158 and the braces 159 are positioned to define the bottom edge 48 of the cementitious exterior sheet 24. The bulkhead 158 includes a bevel 152 along an upper edge, which overhangs the form liner 151 as discussed above with respect to the rails 144. Further, the ends of the bulkhead 158 at its upper edge are chamfered to insert under the bevel 152*c* of the mils 144 on the sides of the casting form 136 to engage the bulkhead with the rails.

With reference to FIGS. 3 and 5, the staging area 126 includes the pair of aligned roller conveyors 122. As shown in FIG. 5 in side view, each of the roller conveyors 122 comprises a frame 160 made of interconnected frame members 161 and four vertical channels 163. A stanchion 162 slidably inserts into each channel 163 and is secured with nuts and bolts at a predetermined height as discused below. A caster assembly 164 connects to the upper end of each stanchion 162. The caster assembly 164 includes a pair of vertical flanges 166, a pin 168 and a V-groove wheel 170. The pin 168 extends between the flanges 166, and the wheel 170 rotates freely on the pin. The V-shaped rails 155 of the member 154 on the casting form 136 travel on the wheels 170. The height of the wheels 170 on the stanchions 162 are vertically higher than the guiderails 124 and 125 so that the casting form 136 can move over the guiderails 124 and 125 from the staging area 126 to the concrete pouring area 130. During this move, the casting form 136 also passes over the elevator 128 which is in its raised position.

Figure 6A:
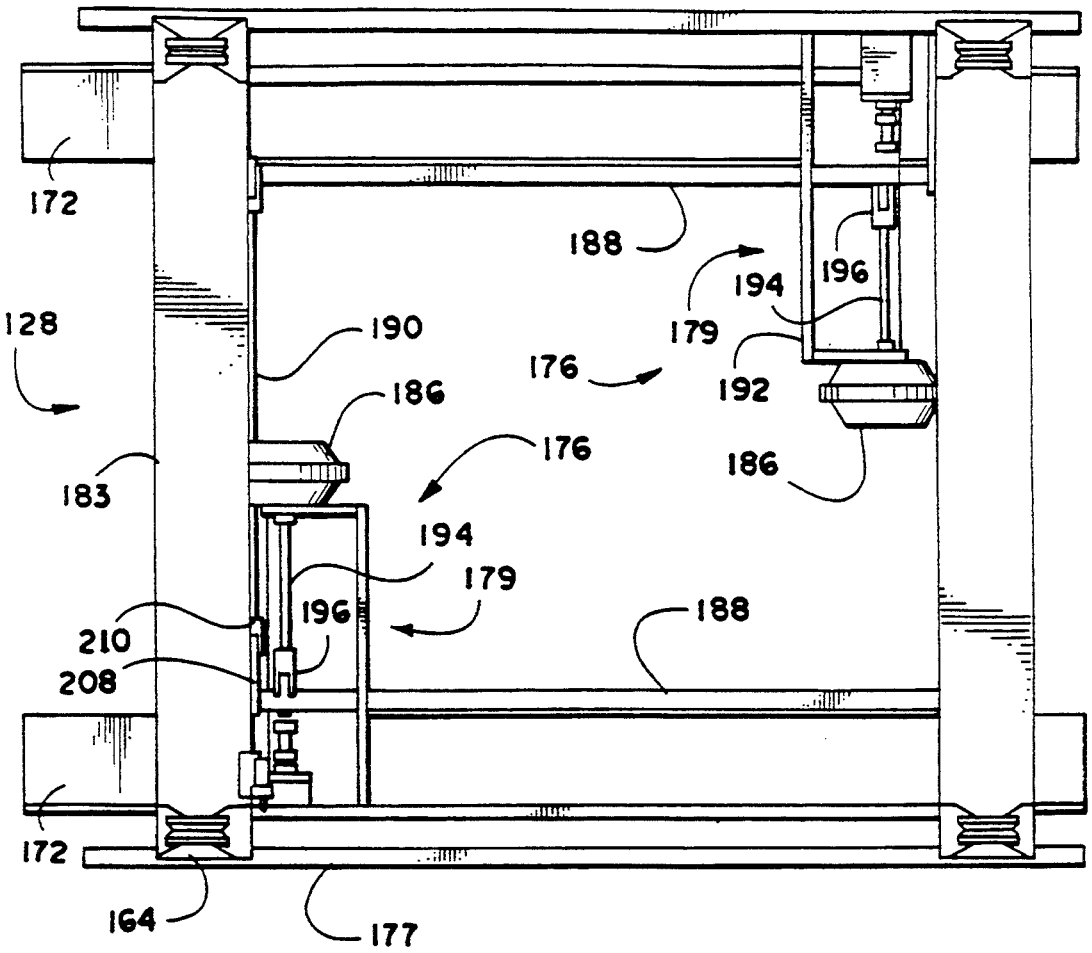
FIG. 6*a* is a top plan view of the elevator that transfers the casting form illustrated in FIG. 4*a* from the concrete pouring area to the curing area of the assembly line illustrated in FIG. 3.
Figure 6B:
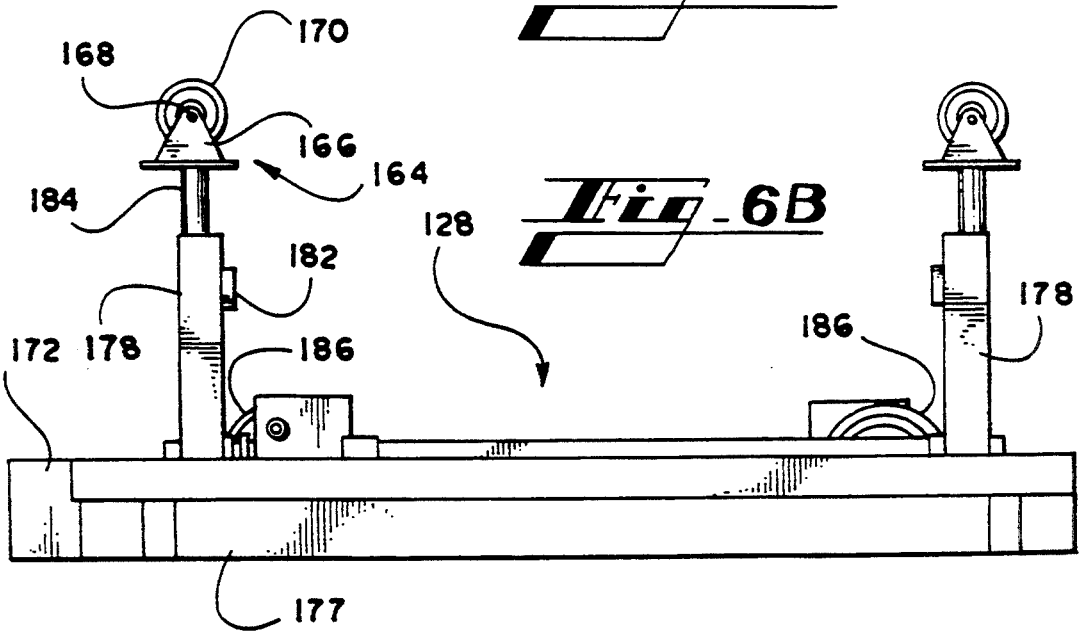
FIG. 6*b* is a side view of the elevator illustrated in FIG. 6*a*.

FIG. 6*a* and 6*b* illustrate a top plan view and a side view, respectively, of the elevator 128. FIG. 6*c* is a perspective view of a portion of the elevator 128 that lowers the casting form 136 filled with concrete to the guiderails 125 in the curing area 135. The elevator 128 comprises a pair of supports 172, a rectangular chassis 174 which is vertically movable with respect to the supports 172, and a two-part elevator mechanism generally designated 176 which raises and lowers the chassis 174. The elevator mechanism 176 includes a pair of identical actuator assemblies 179 mounted in diagonally opposite comers of the elevator 128. The supports 172 in the illustrated embodiment are elongate L-shaped members.

The chassis 174 includes two side members 177 positioned parallel to and outside the supports 172, with four posts 178, one of which is rigidly connected at each of the longitudinal ends of the side members 177, a vertically disposed U-shaped channel 180 attached to an inner side of each of the posts 178, and two transverse members 182 that connect to aligned pairs of the posts. An inner side of each channel 180 is adjacent the outside face of the support 172. A stanchion 184 is slidably received by each channel 180 and is attached thereto at a predetermined height by nuts and bolts. A plate 183 is horizontally disposed between an aligned pair of the stanchions 184. A caster assembly 164 similar to the assembly discussed above mounts to the plate 183 above each stanchion 184. The transverse members 182 connect to an aligned pair of the posts 178 on opposite sides of the elevator 128.

As best shown in FIG. 6*c*, the elevator mechanism 176 includes a pair of air chambers 186 and two transfer rods 188, one of which is associated with each actuator 179. Each of the air chambers 186 is positioned at about the midpoint between the two supports 172 on a support 192 extending laterally from each of the supports 172. The air chamber 186 connect to a supply of compressed air and an actuator (not illustrated). Each air chamber 186 includes a movable shaft 194 that is disposed laterally toward the respective support 172. A clevis 196 connects the shaft 194 to an arm 198 that is attached to a transfer rod 188 disposed parallel to and spaced inwardly from the support 172. Two bearing blocks 200 are attached to the support 172 to hold the transfer rod 188 near each of its longitudinal ends. An arm 202 rigidly connects to each end of the transfer rod 188 outwardly of the bearing blocks 200. A link 204 pivotally connects between the free end of each arm 202 and a lug 206 that rigidly connects to the transverse member 182 of the chassis 174. It will thus be seen that reciprocal motion of the shaft 194 is converted into vertical motion of the chassis by operation of the linked arms and the transfer rods.

A pair of cantilever arms 208 rigidly attaches to each rod 188 inwardly of the bearings 200. The arms 208 at the respective ends of the parallel, spaced apart transfer rods 188 are oriented in opposite directions. One arm 208 is thus oriented downwardly and the associated arm 208 on the opposite transfer rod 188 is oriented upwardly, as best illustrated in FIG. 6*c*. A stabilizer rod 190 pivotally connects to the free ends of each pair of aligned cantilever arms 208. In the illustrated embodiment, a clevis 210 joins the stabilizer rod 190 to each of the arms 208. The stabilizer rod 190 assures that both sides of the elevator 128 move together smoothly and consistently.

With reference to. FIG. 3, the concrete pouting area 130 includes a source of fluidal cementitious material, such as a cement mixer generally designated 212, and a screed bridge 214. A chute 216 attaches to the cement mixer 212 and communicates the cementitious material from the mixer 212 to the casting form 136.

Figure 7:
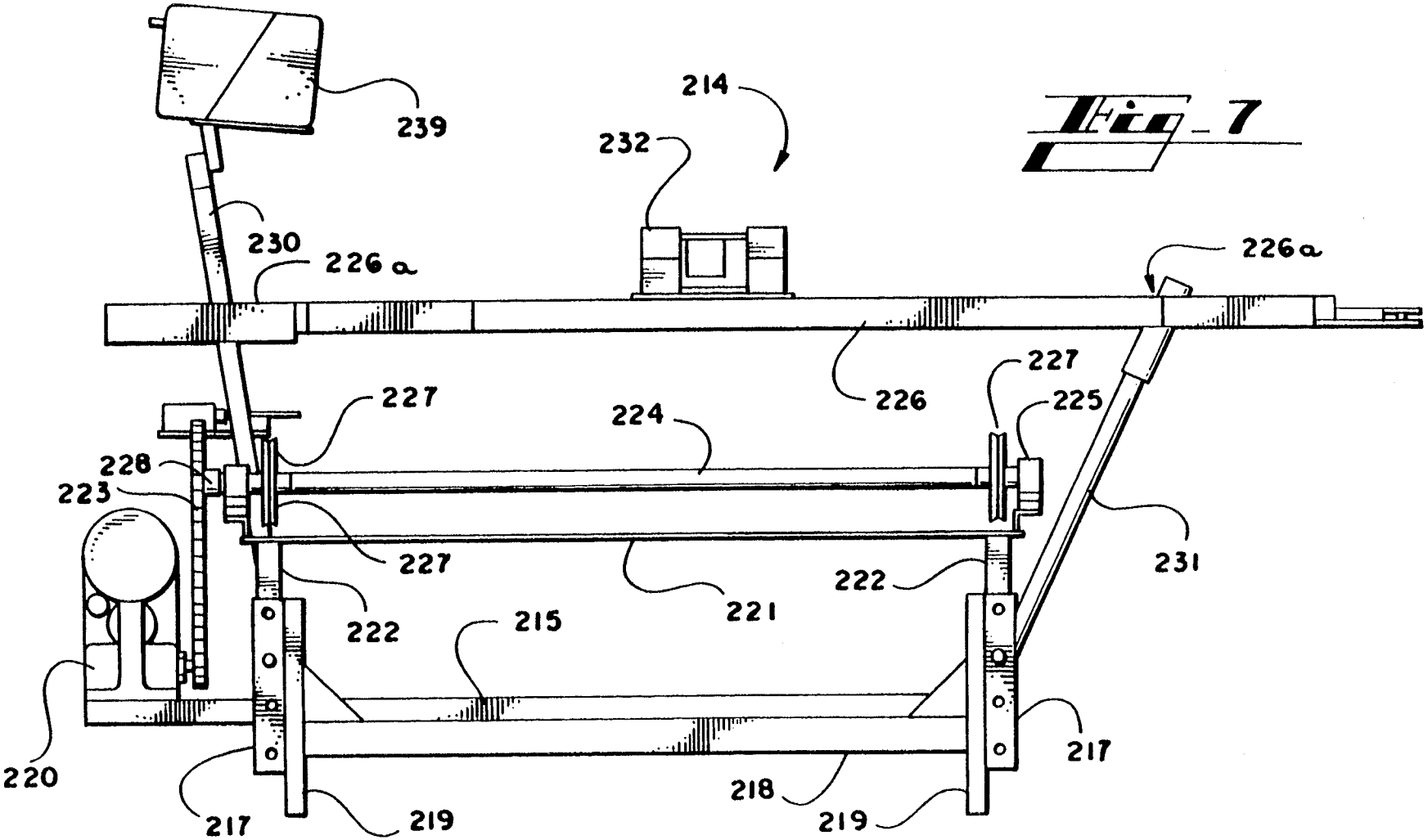
FIG. 7 is a front view of a vibrating screed for leveling the fluidal cementitious material in the casting form illustrated in FIGS. 4*a*–4*e*.

FIG. 7 illustrates a front view of the screed bridge 214 in which a screed vibrates to level the cementitious material contained in the casting form 136. The screed bridge 214 includes a support frame 218 with a horizontal member 215 extending outwardly from a first end of the frame. A drive motor 220 mounts on an outside portion of the member 215 and is operated during the manufacturing process discussed below to move the casting form 136 towards the cement mixer, and then while it is being filled with cement, to move it back through the screed bridge 214 onto the elevator 128. The drive motor 220 is preferably variable speed so that the casting form 136 can move while the cement fills the cavity 148 as fast as the cement is screed off.

A pair of vertical members 219 extend upwardly at the ends of the frame 218 and a U-shaped channel 217 connects on an outside face of each vertical member 219. A stanchion 222 slidably inserts into each of the channels 217 and is connected thereto with nuts and bolts that pass through aligned holes in the channel and the stanchion. A plate 221 extends horizontally between and connects to the upper ends of the pair of stanchions 222. A pair of bearings 225 mount on the upper surface of the plate 221 at its ends. The bearings 225 support a drive axle 224 that may rotate in the bearings. A pair of V-groove drive wheels 227 are rigidly connected to the drive axle 224 with one wheel adjacent each of the bearings 225. The drive wheels 227 are disposed transverse to the longitudinal axis of the drive axle 224. The drive wheels 227 receive the end rails 155 of the casting form 136, as discussed below, to roll the casting form through the screed bridge 214. A drive gear 228 attaches to one end of the drive axle that extends outwardly through the bearing 225. The drive gear 228 is operatively connected by a drive belt 223 to the drive motor 220.

An arm 230 extends upwardly from the first end of the screed bridge 214 and a control box 239 attaches at an upper end of the arm. The control box 239 includes the switches to operate the drive motor 220, a screed motor 232, and the flow of the cementitious material into the casting form 136. A second arm 231 extends outwardly and upwardly from a second end of the frame 218. A screed 226 disposed horizontally attaches to each of the arms 230 and 231 at a pair of connections **226*a*, which connections each include a flexible gasket (not illustrated) such as rubber or the like, thereby providing capability for absorbing relative movement between the screed 226 and the arms. The screed motor 232 attaches to the upper surface of the screed 226 and operates to vibrate the screed in order to level the cementitious material in the casting form 136** during the manufacturing process.

Referring again to FIG. 3, the transfer cart 139 in the transfer area 132 carries the casting forms 136 from the concrete curing area 135 to the discharge area 137 of the loop assembly line 120. The transfer cart 139 travels on the pair of guiderails 133 disposed perpendicular to the two sets of guiderails 124 and 125.

Figure 8:
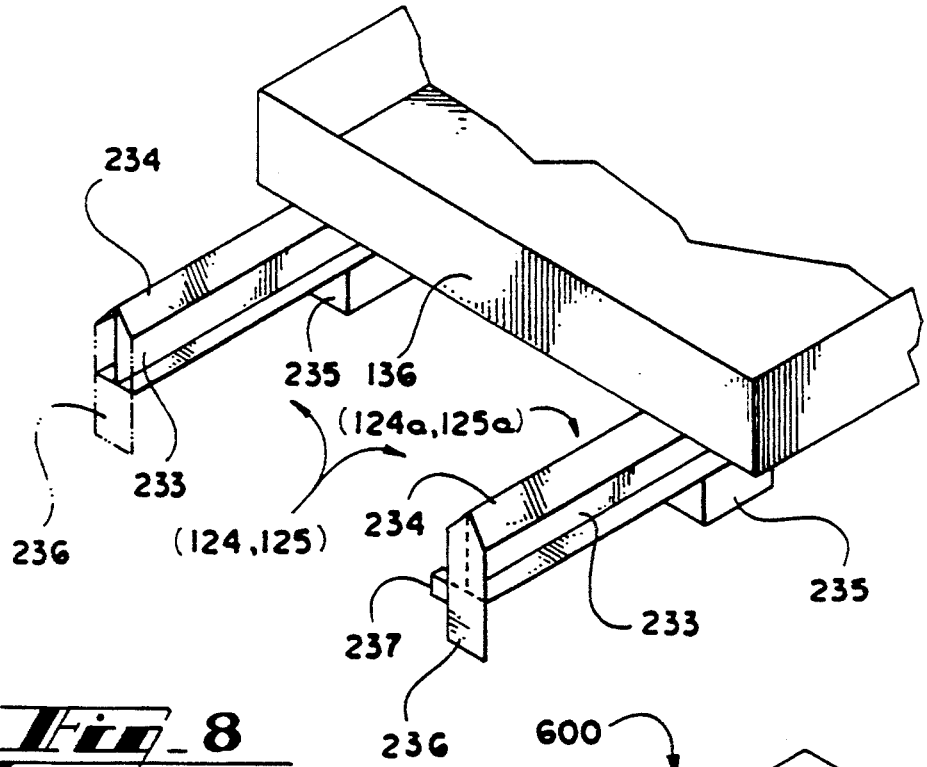
FIG. 8 is a perspective view of a pair of guiderails on which the casting form is moved in the assembly line illustrated in FIG. 3.

As illustrated in FIG. 8, the guiderails 124 and 125 comprise elongate members 233 having an angle member 234 rigidly attached on an upper edge. The angle member 234 defines a V-shape pointing upward. The V-groove wheels 156 on the bottom of the casting form 136 travel on the V-angle member 234 comprising the guiderails 124 and 125. A plurality of spaced apart blocks 235 provide support at the bottom of the members 233. A metal plate 236 attaches as an end support to the distal end of the members 233. Each of the guiderails **124*a* and 125*a* of each pair of guiderails 124 and 125 includes an open-ended tube 237 that attaches at one side of the metal plate 236. The tube 237 receives an end of a movable bar 266 operatively engaged with the transfer cart 139 to align the cart with the guiderails 124** and 125 during manufacturing of the panel 20 as discussed below.

Figures 9A, 9B:
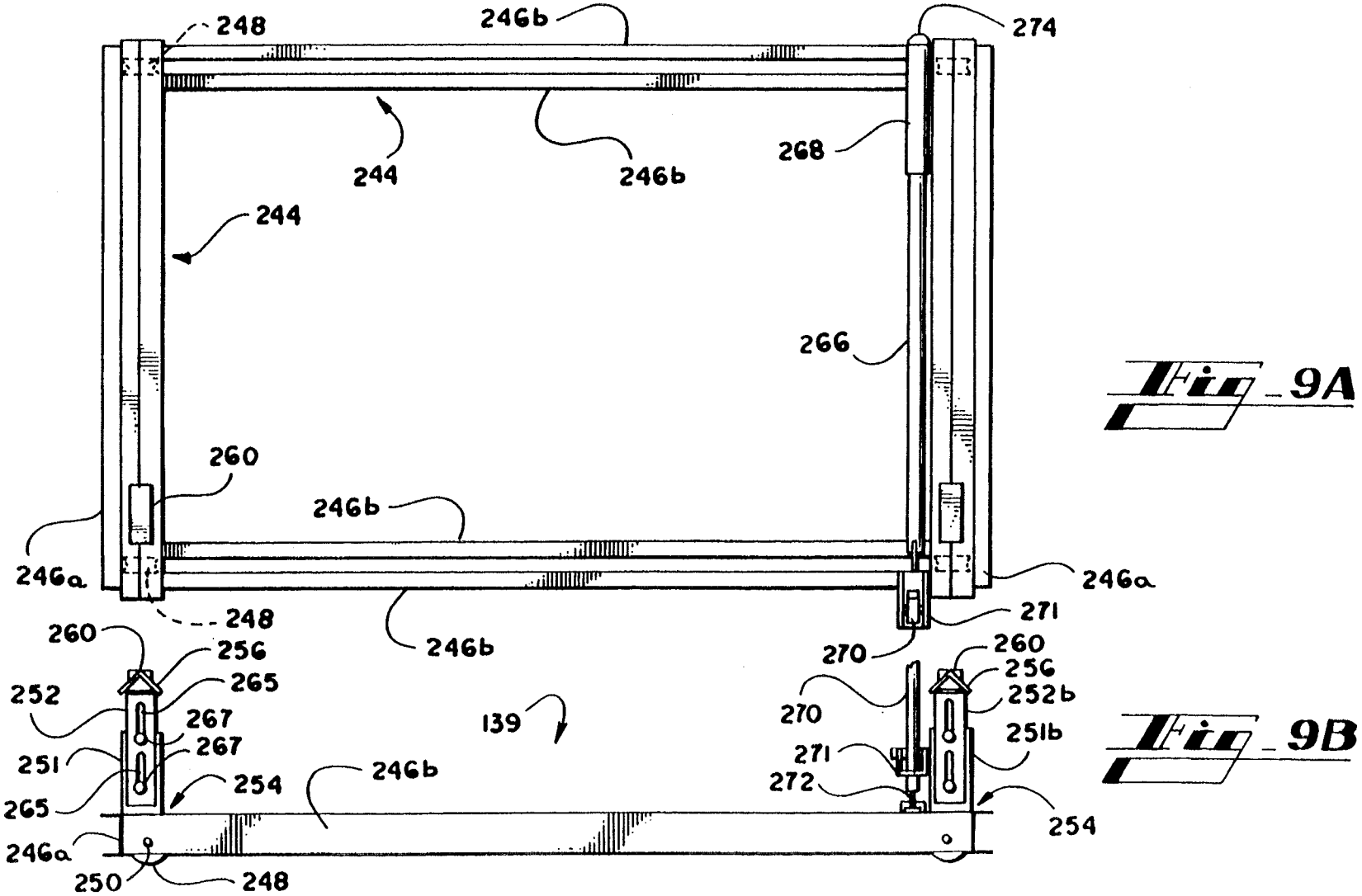
FIG. 9*a* is a top view of a transfer cart in the transfer area of the assembly line illustrated in FIG. 3.
FIG. 9*b* is a side view of the transfer cart illustrated in FIG. 9*a*.

FIGS. 9*a* and 9*b* illustrate a top and a side view of the transfer cart 139. FIG. 9*c* is a cut-away partial perspective view of the transfer cart 139 receiving a casting form 136 that is moved on the guiderails 125 (only guiderail 125*a* is shown.) A rectangular base 244 of the cart 139 comprises a pair of end members 246*a* and two sets of parallel side members 246*b*. The pair of side members 246*b* in each set are spaced apart and join at their respective longitudinal ends to the end members 246*a* at a junction 254. A V-groove wheel 248 mounts under each junction 254 between each of the pair of side members 246*b* on pins 250 near the longitudinal ends of the side members. Each of the wheels 248 freely rotates on the pins 250 and travels on one of the parallel guiderails 133. As illustrated in FIG. 9*c*, each guiderail 133 comprises a metal plate 273 supporting a V-shaped member 277 that is pointed upwardly. The wheels 248 of the transfer can 139 travel on the member 277. The longitudinal ends of the guiderails 133 include stops 276 (one of which is illustrated in FIG. 3) so that the can 139 does not travel off of the guiderails 133.

A vertical channel 251 extends upward from each junction 254 between one set of the side members 246*b* and one of the end members 246*a*. The channels 251 each slidably receive a stanchion 252. Each pair of aligned stanchions 252*a* and 252*b* on opposite sides of the cart 139 support a transverse guiderail 256. The guiderail 256 in cross-sectional view defines a V-shape that points upwardly. Each of the guiderails 256 rigidly connects at its ends to an upper end of the respective stanchion 252. The height of the stanchions 252 is sufficient to position the guiderail 256 in horizontal alignment with the guiderails 124 and 125. As shown in FIGS. 9*a* and 9*c*, a stop 260 rigidly mounts to each of the guiderails 256 adjacent an outer side edge 262 of the transfer cart 139 to prevent the casting form 136 from rolling off the cart.

As best illustrated in FIG. 9*b*, the stanchions 252 (and the other stanchions referred to herein) are adjustable within the vertical channels, such as the channel 251, to be disposed at a predetermined height. The stanchion 252 slidably inserts into the U-channel 251 and is secured thereto by nuts and bolts 267. The bolts extend through bores in the U-channel 251 and through slots 265 in the stanchion. The nuts thread on the bolts and tightly secure the stanchion to the U-channel at the predetermined height.

The cart 139 includes an interlock to assist aligning the cart with the guiderails 124 and 125 and to secure the cart while a casting form 136 is moved onto the cart, as best illustrated in FIG. 9*c*. The interlock comprises the interlock bar 266 that passes through a horizontal guide 268, and a pivotable handle 270 connected thereto. The guide 268 attaches to the upper surfaces of the side members 246*b*, and extends inwardly parallel to the end member 246*a*. The handle 270 pivots at a joint 271 attached to an inner side of the U-channel 251*b*. A pivotable link 272 connects a lower end of the handle 270 to the interlock bar 266. A distal end 274 of the interlock bar 266 is tapered. Upon operation of the handle 270, the tapered end of the bar 266 enters the tube 237 on the plate 236 at the end of the guiderail 125*a*. The longitudinal axis of the guiderails 256 align with the longitudinal axis of the respective guiderail 125 when the tube 237 receives the distal end 274 of the interlock bar 266.

The guiderail 124*a* includes a second open-ended tube 237 at the discharge end 278 of the guiderail 133 to receive the interlock bar 266 for the same function as described in connection with the guiderails 125. The second tube 237 is positioned so that the longitudinal axis of the guiderails 256 on the cart 139 may be aligned with the longitudinal axis of the respective guiderails 124 in the discharge area 137 of the loop assembly line 120. The height of the guiderail 256 also aligns with the height of the guiderail 124, so that the cart 139 may roll onto the rails 124.

Figure 10:
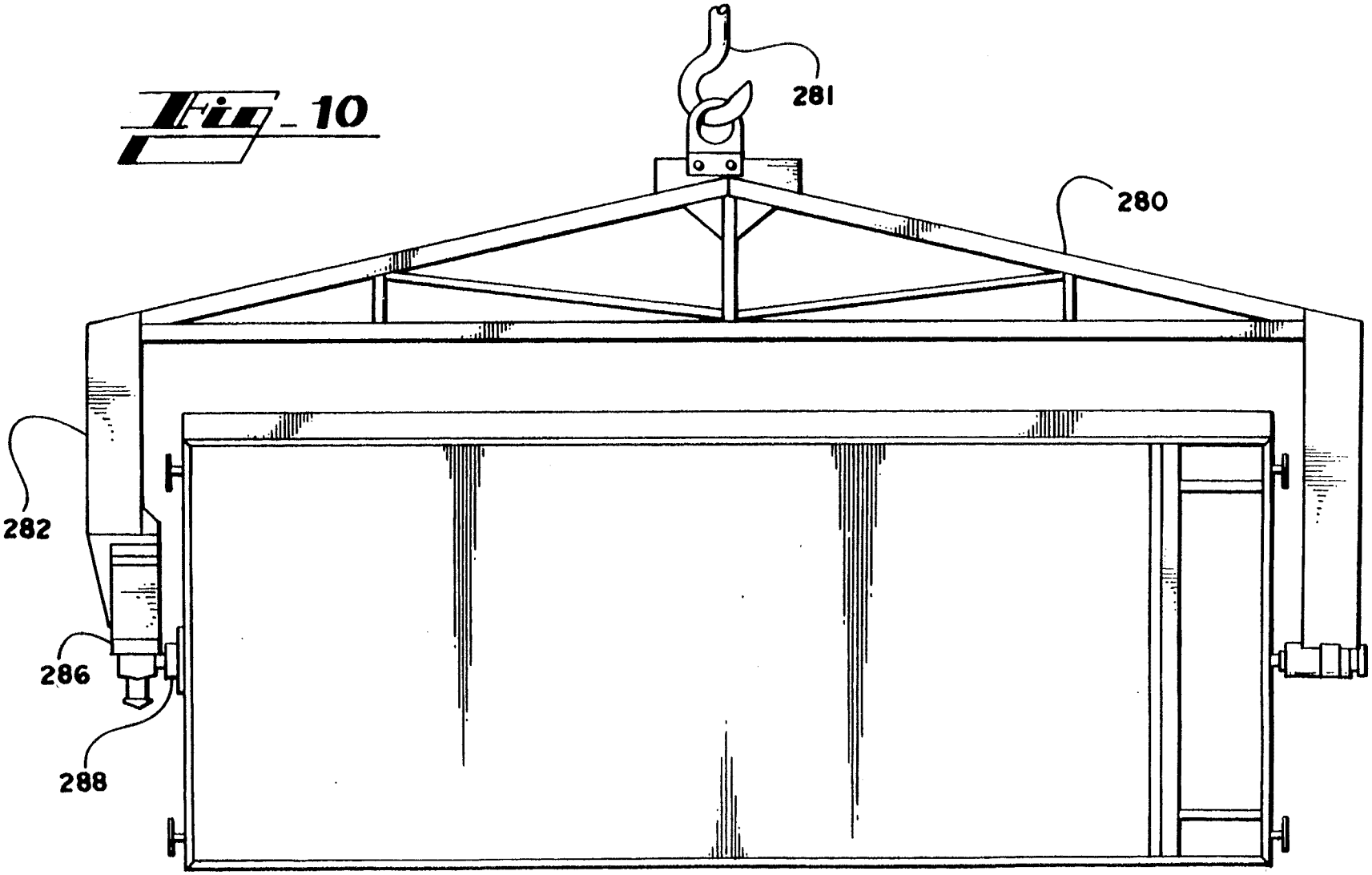
FIG. 10 is a side view of a roll-over truss for transferring the completed wall panel illustrated in FIG. 1 from the assembly line to a stack of wall panels.

FIG. 10 illustrates a roll-over truss 280 carried from a crane (not illustrated) by a hook 281. The roll-over mass 280 engages and inverts the casting form 136 in order to remove casting forms 136 containing completed panels 20 from the guiderails 124 in the discharge area 137 in a manner discussed below. The roll-over truss 280 includes a pair of side arms 282 and 284 extending downward from its ends. A rotatable cylinder 286 connects to the distal end of the arm 282. A rectangular pawl 288 extends inwardly from the rotatable cylinder 286. The pawl 288 is sized to engage the rectangular slot 142*a* in the U-channel 140 of the casting form 136. A pin 290 and support mounts to the distal end of the side arm 284, and the pin is movable in the support between a first outer position and a second inner position. In the second position, the pin 290 engages the circular opening 142*b* in the end U-channel 140 of the casting form 136.

The operation of the assembly line 120 illustrated in FIG. 3 to facilitate handling of the frame 22 and attachment of the cementitious exterior sheet 24 to form the panel 20 will now be discussed. The frame 22 is assembled on the jig 60 as discussed above with respect to FIGS. 1 and 2. The projections 44 extend outwardly from the exterior periphery 28 of the frame 22. As discussed above, the projections 44 preferably are nails.

The casting form 136 illustrated in FIGS. 4*a*–4*e* is positioned on the roller conveyor 122 in the staging area 126. The V-shape rails 155 on the side members 154 on the bottom of the casting form 136 are received in the wheels 170 of the castor assemblies 164, as shown in FIGS. 3 and 5. The casting form 136 is manually pushed towards the cement pouring area 130 and accordingly is moved across the elevator 128 in its upper position. The V-shape rails 155 travel on the wheels 170 in the elevator 128.

With reference to FIG. 7, the casting form 136 then is moved from the elevator 128 through the screed bridge 214 to the concrete pouring area 130. The rails 155 of the casting form 136 travel on the wheels 227 of the screed bridge 214.

A predetermined volume of fluidal cementitious material is then poured into the cavity 148 of the casting form 136. It is preferred that a quick-set type cement be used to form the cementitious exterior sheet. One such cement is REGULATED SET PORTLAND CEMENT manufactured by Ideal Basic Industries, Inc. of Saratoga, Ark. A quick-set cement preferably produces very high early strength and short set times.

The fluidal cementitious material is mixed in the cement mixer 212 and the chute 216 is pivoted to direct a predetermined volume of the cement into the casting form 136. The drive motor 220 pulls the casting form 136 under the discharge chute 216 until the end of the chute is near the end of the casting form. The drive motor 220 is reversed, the vibrating screed is operated, and the flow of cement is started. The flow of cement is controlled by an operator using switches in the control panel 239. As illustrated in FIG. 4*e*, the fluidal cementitious material is received on the form liner 151, and the cavity 148 between the form liner 151 and the bevelled overhang 152 edge of the rails 144 is filled with concrete. As appropriate, hand tools are used to disperse the fluidal cementitious material throughout the cavity 148. The drive gear 228 for the drive wheels 227 is operatively connected to the drive motor 220 by a chain 223 and is rotated thereby to turn the drive wheels. The drive wheels 227 receive the rails 155 of the casting form 136, and rotated by the axle 224, roll the casting form 136 back onto the elevator 128. As the casting form 136 is passed under the screed 226, the motor 232 vibrates the screed. The vibrating screed 226 levels and consolidates the fluidal cementitious material in the casting form 136 and the resilient material in the connections 226*a* dampen the transfer of the vibrations to the frame 218. The plurality of reinforcement bars 54 are then embedded in a portion of the fluidal cementitious material. The reinforcement bars 54 extend from the footer 50 towards the opposite end of the panel 20 and provide additional rigidity for the footer 50 of the panel 20.

After receiving the fluidal cementitious material, the casting form 136 is thus rolled back onto the elevator 128 illustrated in FIGS. 6*a*–6*c*. One of the assembled frames 22 is positioned on the casting form 136 with the projections 44, facing downwardly, embedded in the fluidal cementitious material in the cavity 148. It is preferred that the frame 22, when initially positioned on the casting form 136, be squared to the casting form so that the wall panels 20 are manufactured with consistent size and shape. It is important that the side members 32 do not extend outside the edge of the exterior sheet 24 so that the panels may be aligned consistently one panel to the next when constructing a building. Consistent alignment of the frame 22 to the exterior sheet 24 is accomplished by attaching two squaring jigs 400 and 402 to the frame 22 and the casting form 136, as illustrated in an exploded end view in FIG. 12*a* and in side view in FIG. 12*b*. The squaring jigs 400 and 402 each include a cross member 404 and a pair of pins 406 and 408, one of which extends downwardly from near each longitudinal end of the cross member. A plate 410 is disposed parallel to the transverse axis of the cross member 404 near the pin 406. The plate 410 extends downwardly from a bottom surface of the cross member 404. A brace 412 connects between the pin 408 and a lower distal end of the plate 410 to provide lateral support to the plate.

The squaring jig 400 further includes a pair of spaced-apart plates 414 that attach to the outside face of the cross member 404 and extend downwardly. The plates 414 accordingly are disposed at a perpendicular angle to the plate 410. The length of the plates 410 and 414 preferably are equal to the depth of the side members 32 and the top plate 36.

The squaring jigs 400 and 402 are installed after the frame 22 is positioned on the casting form 136 to embed the projections 44 in the fluidal cementitious material contained in the casting form. The squaring jig 400 is positioned across the the frame 22 parallel with the top plate 36 of the frame. The free ends of the pins 406 and 408 are inserted into the alignment holes 145 in the stiffener 153 of the casting form 136. The plate 410 abuts the outside surface of the side member 32. The plates 414 abut the outside surface of the top plate 36. The plates 412 and 414 thereby cooperate to define a perpendicular comer adjacent the pin 406. One side of a clamp 418 is positioned on each of the plates 414 with the other side of the clamp positioned on the interior surface of the top plate 36. The clamps 418 are tightened to rigidly couple the top plate 36 to the squaring jig 400.

The squaring jig 402 is positioned across the frame 22 and aligned parallel with the bottom plate 34. The plate 410 of the squaring jig 402 abuts the outside surface of the side rail 32 near the bottom plate 34. A wooden wedge 420 is driven between the side member 32 and each of the pins 408 on the squaring jigs 400 and 402. This forces the opposite side member 32 tightly against the plates 410 on the opposite side of the squaring jigs 400 and 402. The frame 22 thus is tightly held in square relationship with the casting form 136. An especially preferred squaring rig is discussed below. It is installed after moving the casting form 136 to the guiderails 125.

The casting form 136 is then lowered on the elevator 128 to the guiderails 125. With reference to FIGS. 6*a* and 6*c*, the actuator for the air chambers 186 is operated to move the shafts 194 toward the respective air chambers. The shafts 194 move laterally and pull the arms 198, causing the transfer rods 188 to rotate in a first direction. Such rotation of the transfer rods 188 pivots the arms 202 downwardly and the links 204 connecting the arm 202 to the transverse members 182 of the chassis 174 thereby move. The chassis 174 in response moves downwardly. The chassis 174 moves evenly because the stabilizer rod 190 is connected between the two transfer rods 188 of the two part elevator mechanism 176. The wheels 156 on the bottom of the casting form 136 thereby contact the guiderails 125. The casting form 136 with the frame 22 is then manually moved along the guiderails 125 through the curing area 135 of the assembly line 120. The squaring jigs 400 and 402 remain secured to the frame 22 until the cementitious material in the cavity 148 is set sufficiently to prevent the projections 44 from moving in the cement and to hold the cement skin to the frame.

Then the elevator 128 is raised to permit a new, empty form 136 to proceed to the cement filing station 130. The air pressure to the air chambers 186 is applied and the shafts 194 move laterally out of the respective air chamber. The transfer rods 188 rotate in a second opposite direction causing the arms 202 to pivot upwardly. This movement is transferred to the transverse members 182 by the links 204 and the elevator moves upwardly.

As additional casting forms 136 are filled and moved into the curing area 135, the casting forms 136 are manually moved in sequence onto the transfer cart 139. The transfer cart 139 travels on the guiderails 133 to move the casting forms 136 to the discharge area 137. The guiderails 256 of the cart 139 are aligned with the guiderails 125 in the curing area 135 as illustrated in FIG. 9*c*. This is accomplished by moving the cart 139 to the end of the guiderails 133 so that the interlock bar 266 is adjacent the tube 237 on the end plate 236 of the guiderail 125*a*. The handle 270 is moved from a first upright position to a second lowered position. This causes the pivotal link 272 to push the interlock bar 266 through the guide 268 and into the tube 237. The interlock bar 266 is thus engaged with the guiderail 125*a* and prevents the transfer cart 139 from moving laterally. The casting form 136 is then moved onto the cart 139 as the wheels 156 roll along the V-shape guiderails 125 and onto the guiderails 256 of the cart.

Then the handle 270 is moved from its second position to the first upright position. This withdraws the interlock bar 266 from the tube 237. The cart 139 is manually moved on the guiderails 133 to the discharge end 278. This positions the interlock bar 266 near the second tube 237 on the guiderail 124*a*. The handle 270 is again pivoted from a first upright position to a second down position. This drives the interlock bar 266 through the guide 268 and into the second tube 237 to align the guiderails 256 with the longitudinal axis of the guiderails 124 in the discharge area 137 of the assembly line 120. The casting form 136 is moved off of the guiderails 256 of the transfer cart 139 onto the guiderails 124 in the discharge area 137. It may be appreciated that the guiderails 125 and 124 may have a slight slope from a high point near the elevator 128 to a low point in the discharge area 137 to assist manually pushing the filled casting forms 136 along the guiderails.

The crane 134 is then operated to move the roll-over truss 280 over the casting form 136. As illustrated in FIG. 10, the rectangular pawl 288 extending from the rotatable cylinder 286 engages the rectangular slot 142*a* in the end U-channel 140. The pin 290 is moved from a first outward position to a second inward position through the slot 142*b* of the opposite end U-channel 140. The crane 134 is operated to raise the casting form 136 off of the guiderails 124 and to move the casting form 136 to a stack of previously completed panels 20. The casting form 136 is rotated to face the frame 22 downward as permitted by the rotatable cylinder 286. A spacer is positioned on each of the four corners of uppermost panel 20 in the stack. With the frame 22 downward, the crane 134 is operated to lower the casting form 136 onto the spacers and the stack of panels 20 previously manufactured. The bevel 152 along the upper edge of the rails 144 on the sides and the ends of the casting form (or one end and the bulkhead 158, if used) overhangs the solidified cementitious material of the exterior sheet 24 and prevents the panel 20 from falling out of the casting form 136 during rotation and placement on the stack.

After the frame 22 is positioned on the spacers, the wing nuts 146 are loosened, as illustrated in FIG. 4*e*. This releases the hold of the four rails 144 against the U-channels 140 of the casting form 136. The rails 144 break away from the sides and the ends of the casting form 136 and release from the cementitious exterior sheet 24. The bulkhead 158, if used, is released when the braces 159 are removed after first releasing the rail 144 at the end of the casting form. The casting form 136 is raised by the crane 134 away from the panel 20, and is then rotated and transferred to the staging area 126 where the casting form is placed on the roller conveyor 122. The pin 290 is then moved to its first outer position to disengage from the casting form 136. The pawl 288 is disengaged from the casting form 136 and the crane 134, thus freed, is moved to the discharge area 137 to pickup another casting form. The interior of the released casting form 136 is prepared for receiving additional cementitious material as described above. This involves coating the form liner 151 and the rails 144 with a fluid for smooth release of the cement from the casting form 136. Such release fluids are well-known to those of ordinary skill in the art. The wing nuts 149 are tightened down to hold the rails 144 firmly against the casting form 136.

Using the cement described above, satisfactory modular panels 20 are manufactured on a production basis using the apparatus and method described above. The time from initial assembly of the frame 22 to removal from the line of a finished panel 20 is approximately 40 minutes with eight casting forms 136 moving on the assembly line. Rapid setting of a cementitious sheet 24 enables the panels 20 to be manufactured at the construction site, if desired. One comer of the slab foundation may be allocated for a manufacturing area. Finished panels may be removed from the line and moved into position on the edge of the foundation as discussed below. Rapid setting cement also allows a manufacturer to meet increased demand without having to acquire additional casting forms 136. Other cements having longer set times may be used and in such case, a longer assembly line with more casting forms 136 can be used.

Figure 16A:
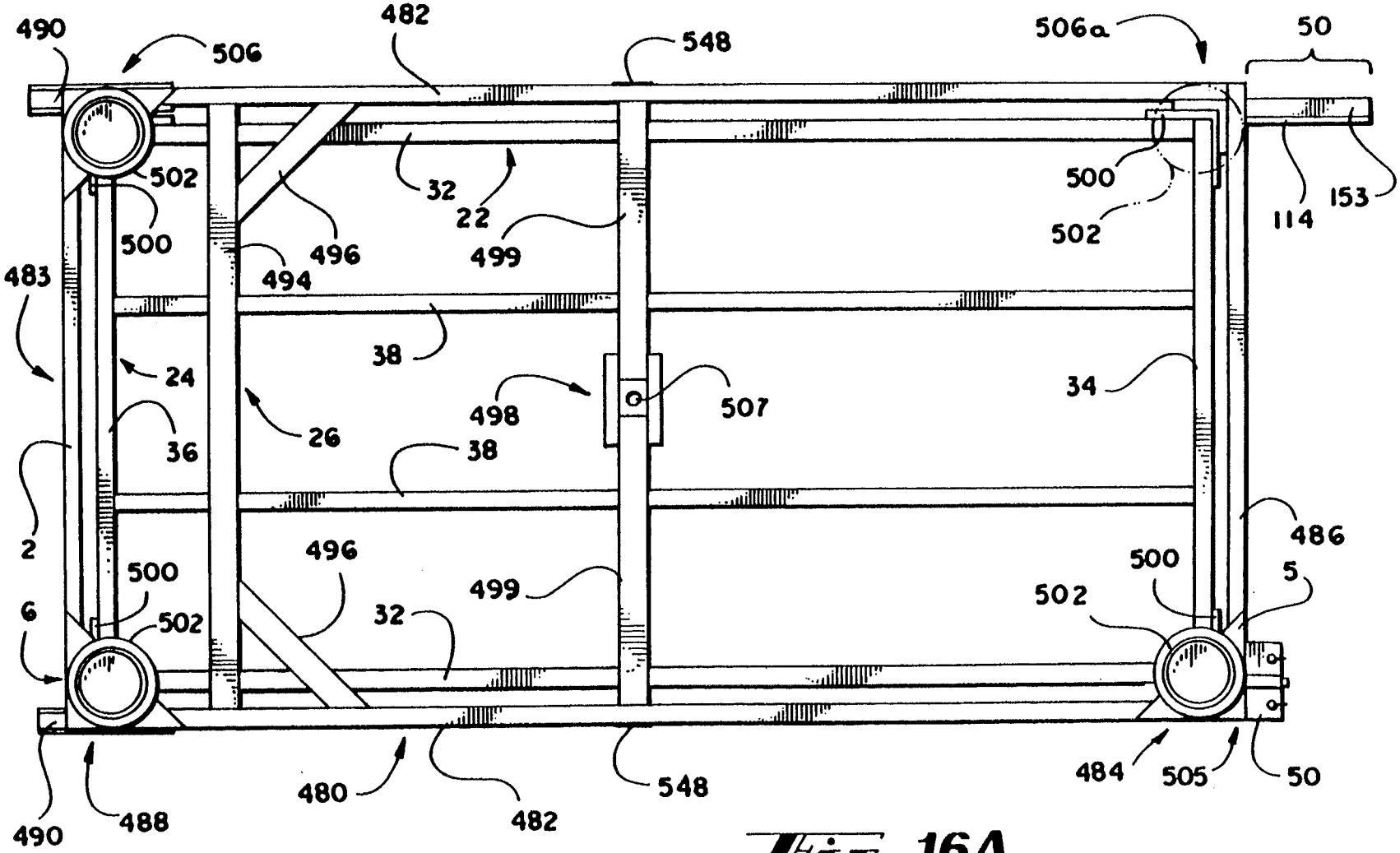
FIG. 16*a* is top view of a squaring jig for aligning the frame of the wall panel with the casting form.

FIG. 16*a* illustrates a top view of an especially preferred squaring jig 480 for aligning the frame 22 with the casting form 136. The squaring jig 480 comprises two parallel side tubes 482 joined together at a first respective end 484 by a cross tube 486 and a floating bulkhead 488 slidably received on the side tubes 482 to close an open end 483 of the squaring jig. The floating bulkhead 488 includes a pair of side tubes 490 that are larger in cross-section than the side tubes 482 for being slidably received thereon. The side tubes 490 have a short length and are rigidly connected to a cross member 492. The floating bulkhead 488 bolts to the side tubes 482 at a predetermined position so that the squaring jig 480 has a length to fit on and forcibly square the frame 22. Typically, the length of the frame frame 22 is one foot shorter than that the exterior sheet 24 as discussed above in order to provide the footer portion 50 of the exterior sheet. In a preferred embodiment, the frame is eight feet long and the exterior sheet 24 is nine feet long. The casting form 136 with its bulkhead 158, however, may be used to manufacture exterior sheets up to ten feet long. The side tubes 482 thus are of a length that permits pinning the floating bulkhead 488 at one of several predetermined positions from the first end 484, such as at eight feet, nine feet, and ten feet, to accommodate different lengths for the frame 22.

A cross member 494 rigidly connects between the two side tubes 482 near the open end 483 in order to maintain the open end of the jig 480 square with the first end 484. The cross member 494 assures that the jig 480 is square despite any lateral play in the floating bulkhead 488 that is slidingly received and bolted on the side tubes 482. One of a pair of braces 496 connects at an angle between the cross member 494 and each of the side tubes 482 for additional rigidity.

A lifting member 498 (discussed below) with an air cylinder 507 is disposed between the side tubes 482 medial the ends of the squaring jig 480 with a pair of supports 499 that connect to the side tubes 482 at one of several predetermined points in order to position the lifting member equally between the ends of the jig and to keep the squaring jig balanced. The lifting member 498 connects the squaring jig 480 to an overhead jib hoist for handling the squaring jig and the air cylinder 507 raises and lowers the squaring jig.

Each comer 506 of the squaring jig 480 includes an alignment shoe 500 that abuts against the outside faces of the side members 32 and the plates 34 and 36 that form the comers of the frame 22. An air chamber 502 mounts on a triangular plate 501 in each comer 506 and a piston arm extends downwardly to an upper surface of a respective corner of the frame 22. The piston arm pushes against the frame 22 when the jig is removed. One of the air chambers 502 is shown in phantom in the corner 506*a* in order to illustrate the alignment shoe 500. Air flow actuators 503 attach to an outside comer 505 of the squaring jig 480 and connect the air chamber 502 and the lifting cylinder 507 (discussed below) of the lifting member 498 to a supply of compressed air.

Figure 16B:
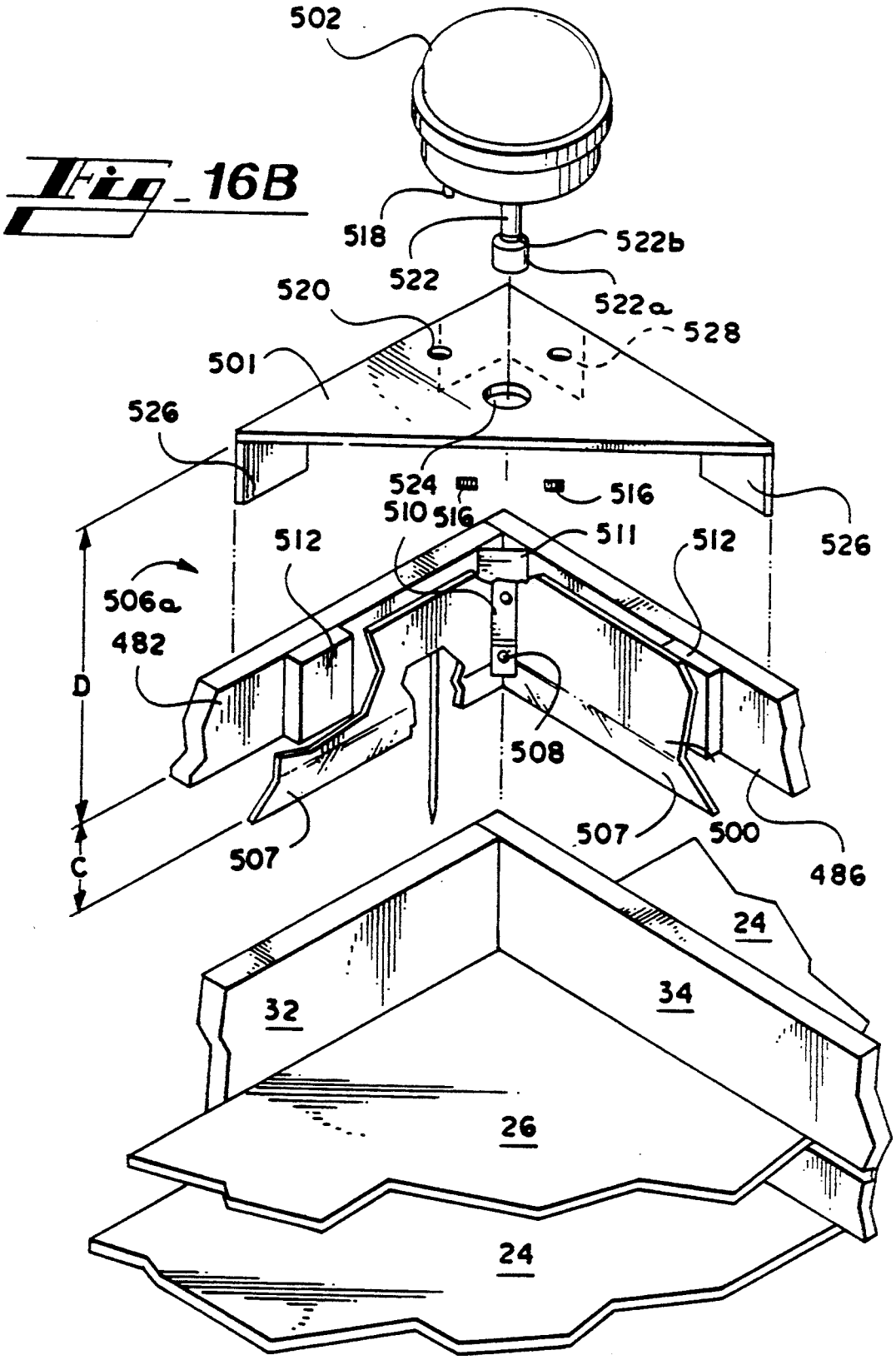
FIG. 16*b* is a exploded perspective view of a corner of the squaring jig illustrated in FIG. 16*a*.

FIG. 16*b* illustrates in exploded view the comer 506*a* defined by the side tubes 482 and the cross tube 486 of the squaring jig 480. The alignment shoe 500 is a metal sheet folded to an approximate 90° angle for positioning in the comer 506. A portion 507 of each side of the shoe 500 angles outwardly and provides a funnel for catching the upper edges of the frame 22 when the squaring jig 480 is placed on frame. A plate 510 with two holes therein is welded across the vertex of the shoe 500 and corresponding openings are bored in the vertex for passage of a bolt therethrough. A second plate 511 with tapped holes corresponding to those in the plate 510 is welded in the comer between the side tube 482 and the cross tube 486. One of a pair of bolts 508 extends through each of the holes in the plate 510 and the shoe 500 and threads into the tapped hole in the plate 511, thereby connecting the shoe to the squaring jig 480. A plurality of washers are preferably inserted on each bolt between the back of the shoe 500 and the plate 511. A greater number of washers are preferably used on the upper bolt 508 then are used on the lower bolt to angle the shoe 500 downwardly. This facilitates squaring the form 22 when the squaring jig 480 is positioned on the form.

Each of the lateral ends of the alignment shoe 500 float against a tube 512 welded to an inside face of the side tube 482 and the cross tube 486. The tubes 512 space the ends of the shoe 500 outward from the side tube 482 and the cross tube 486. The shoe 500 is thereby spaced apart from the comer 506. The alignment shoes 500 in the floating bulkhead 488 mount in the same manner to the side tubes 490 and the cross member 492.

A shim (not illustrated) may be inserted between the tube 512 and the outside face of the shoe 500 to further space the shoe and to maintain the square comer of the shoe. The shim preferably includes an outward extending flange that rests on the upper surface of the tube 512 and a screw extend through the flange to connect the shim to the tube.

The air chambers 502 each mount to one of the triangular plates 501 with nuts 516 threaded on bolts 518 extending downward through holes 520 in the plate. Each of the plates 501 is vertically spaced from an upper surface of the side tubes 482 and the cross member 486 by a pair of side supports 526 and a comer support 528 that rigidly connect between the tubes, the cross member, and the triangular plate. A piston arm 522 extends downward from the air chamber 502 through a hole 524 in the plate 501. The piston arm 522 includes an adjusting shoe 522*a* with a jam nut 522*b* that cooperate to adjust the depth that the squaring jig 480 moves with respect to the frame 22. The piston arm 522 is movable between a first retracted position and a second extended position against an upper surface of the plate 34 or 36 in the frame 22. The length of travel of the piston arm 522 is sufficient to raise the squaring jig 480 so that the bottom edge of the shoe 500 will clear the frame 22 when the squaring jig is removed. The depth C of the alignment shoe 500 between a bottom surface 530 of the tube 482 and a bottom edge 532 of the shoe is preferably less than the depth B of the members 32 and the cross plates 34 and 36 of the frame 22 (see FIG. 1), and is of a depth sufficient to force the frame 22 into square. The plates 501 of the floating bulkhead 488 mount in the same vertically spaced relation to the side tubes 490 and the cross member 492 with the side supports 526 and the comer support 528.

A pin 534 attaches to a bottom surface of the side tube 482 near the comer 506 of the squaring jig 480, and extends downwardly in spaced relation to the alignment shoe 500. The pin 534 tapers from the top to a narrow bottom end that inserts through the hole 145 of the flange 153 to align the squaring jig 480 to the casting form 136 as discussed above. The taper permits the squaring jig 480 to be loosely positioned over the frame 22 on the casting form 136 and as the squaring jig moves downwardly against the frame, the taper on the pins 534 forces the squaring jig into alignment with the casting form. One pin 534 is positioned in each of two laterally opposite comers so that persons placing the squaring jig must insert only one pin on each side of the squaring jig.

Figure 16C:
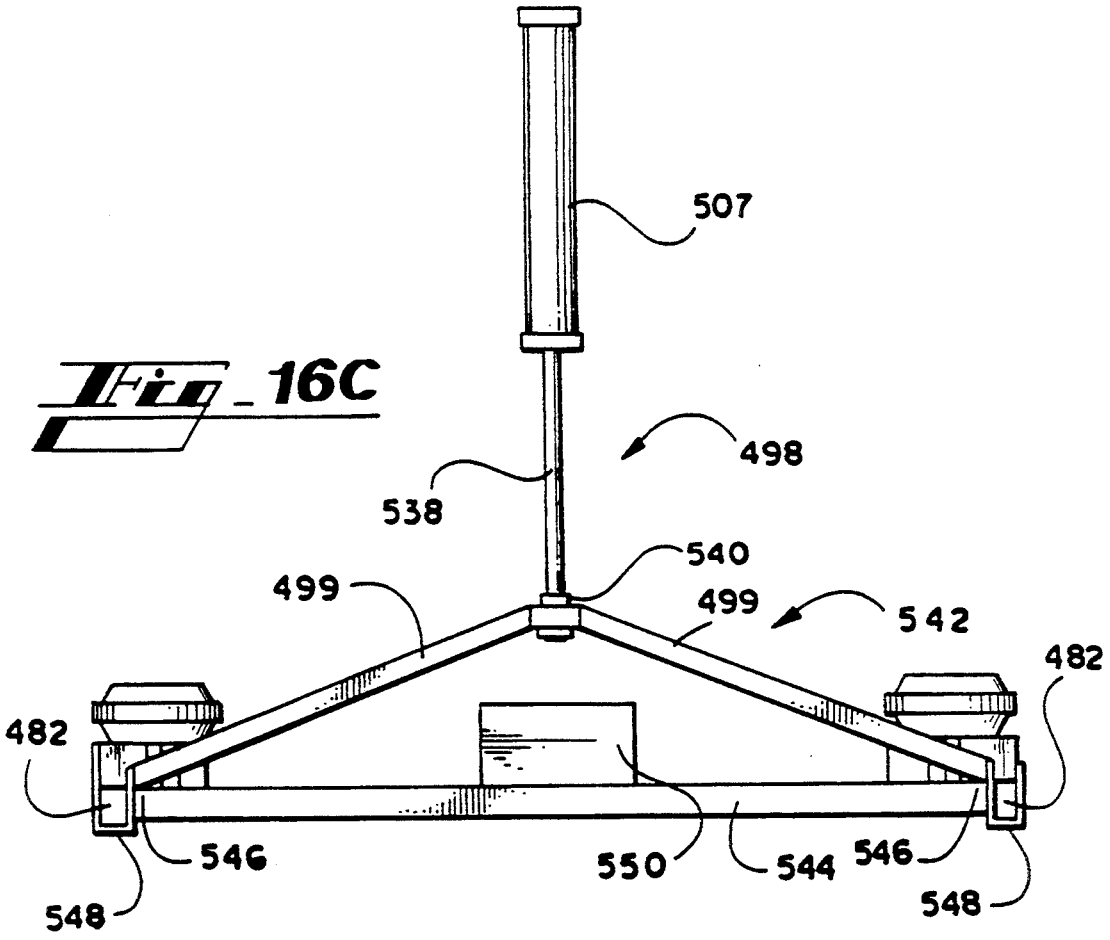
FIG. 16*c* is an end view of a lifting member that connects the squaring jig illustrated in FIG. 16*a* to an overhead jib hoist for placing and removing the squaring jig on the frame of the wall panel.

FIG. 16*c* illustrates an end view of the lifting member 498 that connects the squaring jig 480 to an overhead jib crane (not illustrated) for placing the jig on the frame 22 and for removing the jig. The lifting member 498 includes the air-operated chamber 507 that attaches to a hook (not illustrated) of the jib crane. A movable piston rod 538 extends downwardly from the chamber 507 and engages a thread in a connector 540 bolted to an upper portion of an A-frame support 542. The threaded engagement between the end of the piston rod 538 and the connector 540 provides a rigid connection and has the effect of vertically raising the center of gravity for the squaring jig 480 so that the jig is more easily kept level while being moved. The A-frame support 542 includes the pair of supports 499 and a cross member 544 rigidly connected to a bottom side of the supports at their distal ends 546. The A-frame support 542 attaches to the side tubes 482 with a pair of U-shaped clips 548 that rigidly connect to one of the ends 546 of the supports 499 and the cross member 544 and then bolts to one of the two side tubes 482. A vibrator motor 550 bolts to the cross member 544 medial the ends 546 and is operable to vibrate the squaring jig 480 when it is positioned on the frame 22 to force the alignment shoes 500 downwardly and against the frame.

The squaring jig 480 illustrated in FIG. 16*a* is placed on the frame 22 and the casting form 136 after the casting form is moved onto the guiderails 125 to a position immediately adjacent the elevator 128. The overhead jib hoist carries the squaring jig 480 on a hook (not illustrated). The air actuator 507 is operated to extend the piston rod 538 downwardly and thereby lower the squaring jig 480 onto the the frame 22. The pins 534 insert into the holes 145 in the stiffeners 153 to begin aligning the squaring jig with the casting form 136. The alignment shoes 500 abut the outside faces of the side members 32 and the plates 34 and 36 that define the corners of the frame 22. The vibrator motor 550 is operated to vibrate the squaring fig 480 and thereby assist forcing the squaring jig downward. The alignment shoes 500 push inwardly against the members of the frame 22 to force the frame square. The piston arms 522 fully retract into the air chambers 502 and the adjusting shoes 522 on the distal ends of the arms contact the upper surface of the plate 34 (or 36) in the frame 22 when the squaring jig 480 is fully seated on the frame.

The squaring jig 480 is left in position on the frame 22 and the casting form 136 for approximately four to five minutes while another casting form is being filled with concrete, as discussed above. The squaring jig 480 is removed and held by the overhead jib hoist before the next filled casting form 136 is lowered by the elevator 128 onto the guiderails 125.

Removal of the squaring jig 480 is accomplished by moving the actuator 503 to supply compressed air to the air chambers 502 and to the lifting chamber 507, which communicate with the same source of pressurized air. The piston arms 522 simultaneously move downwardly from the respective air chambers 502 from a first retracted position to a second extended position. The extension of the arms 522 pushes the squaring FIG. 480 upward with respect to the frame 22. A portion of the compressed air is communicated to the lift chamber 507 which begins retracting the piston rod 538 to raise the squaring jig from the frame 22. When the piston arms 522 reach their full extent, the supply of air is then substantially supplied to the lifting chamber 507 which fully retracts its piston rod 538 to lift the squaring jig 480 from the frame 22.

Figures 11A, 11B:
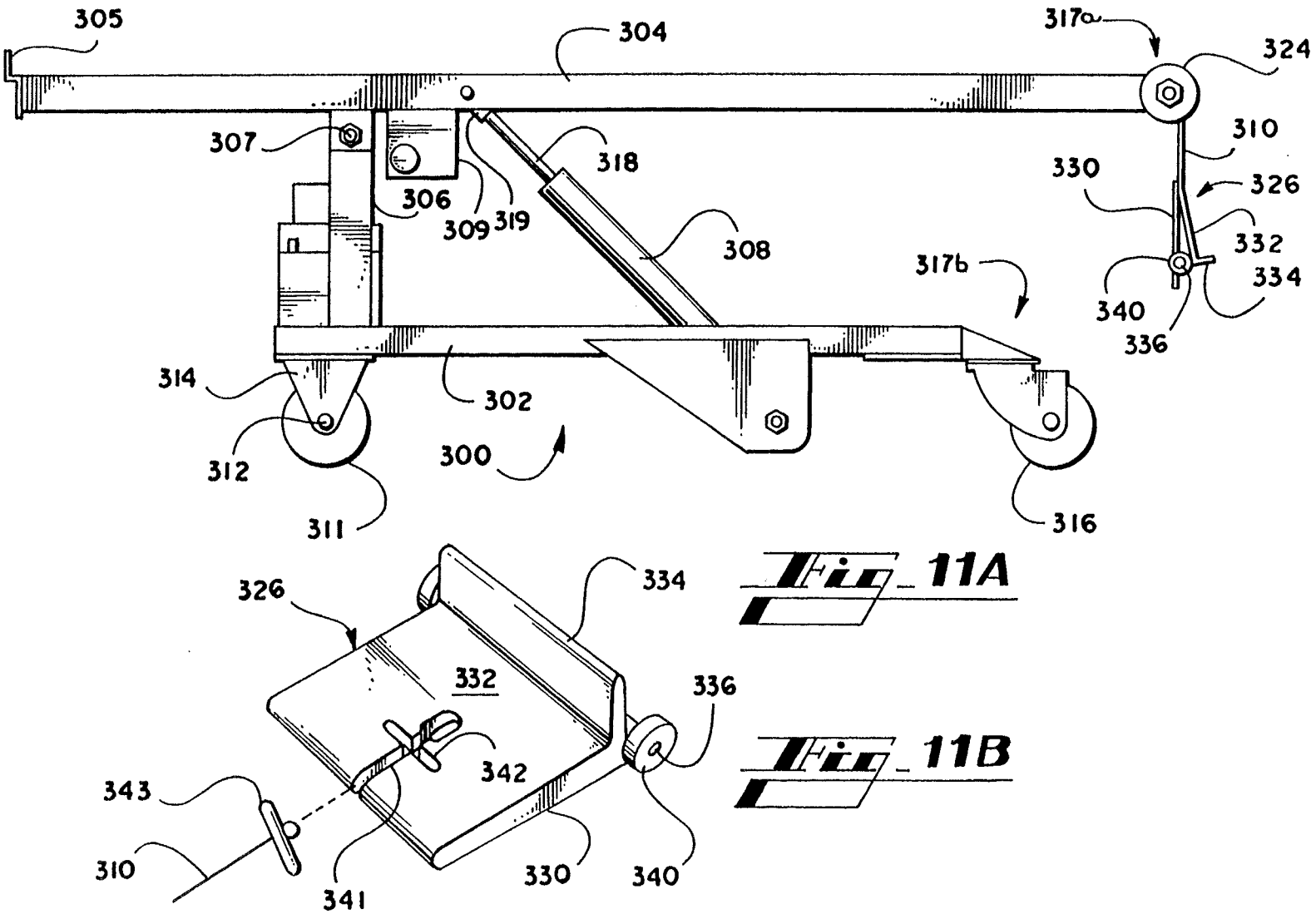
FIG. 11*a* is a side view of a can for transporting and handling the wall panel illustrated in FIG. 1.
FIG. 11*b* is a perspective view of the lift and roll guide used with the can illustrated in FIG. 11*a*.

FIG. 11*a* illustrates a side view of a wheeled cart 300 for transporting and handling panels 20 made according to the method disclosed herein, and particularly, for handling those panels having a cementitious exterior skin. Panels with exterior skins of wood or other like materials typically are sufficiently low in weight that workmen may readily move the panel without using a cart. The cart 300 includes a base 302, a lift table 304 pivotally connected at a joint 307 to a vertical support 306 attached to the base 302, a hydraulic cylinder 308, and a winch 309 and cable 310. The hydraulic cylinder 308 pivotally pins to the base 302. A piston arm 318 extends from the hydraulic cylinder 308 and the distal end 319 pivotally pins to the lift table 304 at a point spaced forwardly from the joint 307. The electric winch 309 mounts to the bottom of the lift table 304. The cable 310 from the winch 309 passes over a guide roller 324 at a front end 317*a* of the lift table 304. A lift and roll guide 326 is removably connected to the end of the cable 322.

The lift and roll guide 326, best illustrated in perspective view in FIG. 11*b*, comprises a folded sheet of metal having a lower plate 330, an upper plate 332, and a stop plate 334 upstanding at a rear edge of the upper plate. A pipe 336 rigidly connects along a back edge of the lower plate 330. The pipe 336 receives a pair of open-ended cylinders that freely rotate on the pipe as wheels 340 on opposite sides of the lift and roll guide 326. A nut and bolt (not illustrated) passing through each end of the pipe 336 prevents the wheels 340 from coming off of the pipe. The upper plate 332 includes a first slot 341 that extends longitudinally from a front edge rearward in the upper plate 332 and a second transverse slot 342 medial the front edge of the plate and the end of the first slot. The first slot 341 is wider from the second slot 342 rearward to its end than from the front edge to the second slot. The transverse slot 342 receives a bracket 343 that secures with a connector 344 to the end of the cable 310. The bracket 343 inserts longitudinally in the wider rear portion of the slot 341 with the cable 310 entering the forward portion of the slot. The bracket 343 is rotated to be parallel to the second slot 342 and is then moved forward so that the bracket engages the second slot.

Continuing the description of the cart 300, a stop bracket 305 extends upwardly at a rear end of the lift table 304. A pair of fixed casters 311 connect on a bottom surface at the rear end of the base 304. Each of the casters 311 rotates on a pin 312 connected between a pair of flanges 314 depending from the base 302. A pair of swivel casters 316 connect to the base 302 at a front end 317*b* of the cart 300. The swivel casters 316 permit the cart 300 to be turned while transporting one of the panels 20.

When the panels are to be installed as an exterior wall of a building, the cart 300 illustrated in FIG. 11*a* is positioned with its front end 317*a* adjacent the bottom edge 48 of the uppermost panel 20 in the stack of panels. The spacers (described above) between the panels 20 in the stack provide a gap between the interior periphery 29 of the uppermost panel 20 and the exterior face of the exterior sheet 24 of the panel below, and the cable 310 is threaded through the gap from the bottom edge 48 to outside of the top plate 36. The bracket 343 is passed through the slot 341 of the lift and roll guide 326 and engaged in the transverse slot 342 as described above to connect the lift and roll guide 326 to the cable 310. The winch 309 is operated to rewind the cable 310 and bring the lift and roll guide 326 under the panel 20. The top plate 36 is contacted by the stop plate 334 of the guide 326 and the panel elevates at a slight angle. The winch 309 is operated to pull the uppermost panel 20 off the stack and onto the lift table 304 until the bottom plate 34 is stopped by the bracket 305 at the end of the lift table 304.

Figure 17:
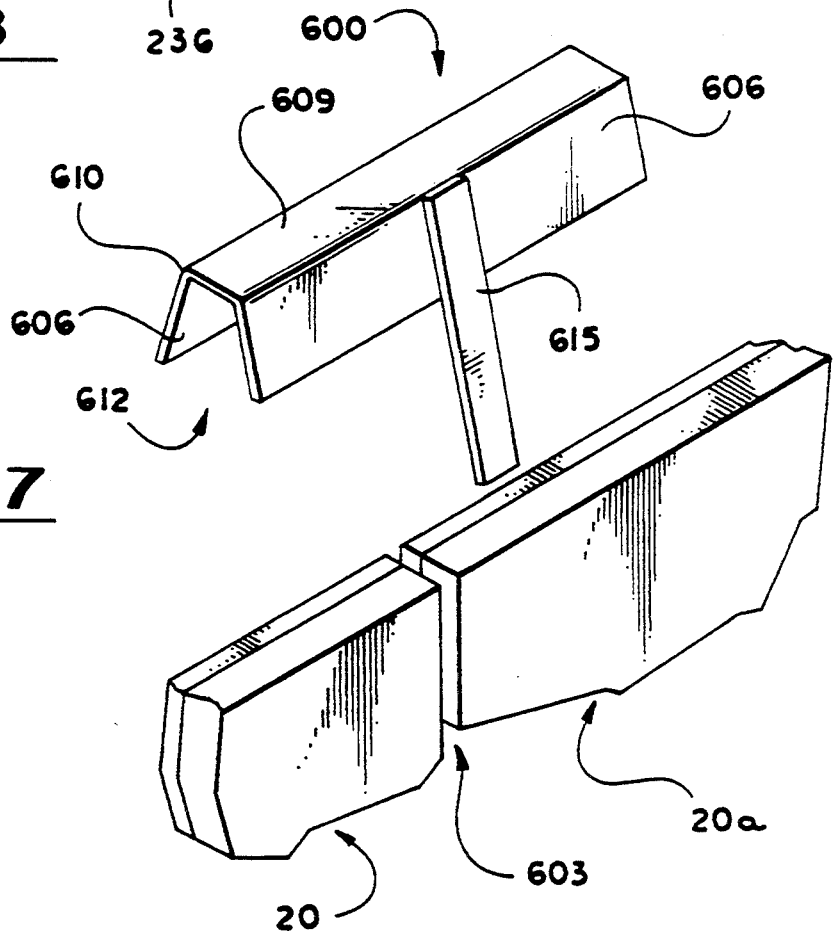
FIG. 17 is a perspective view of a tool to hold a wall panel in a near vertical position during assembly of a wall using such panels.
Figure 13:
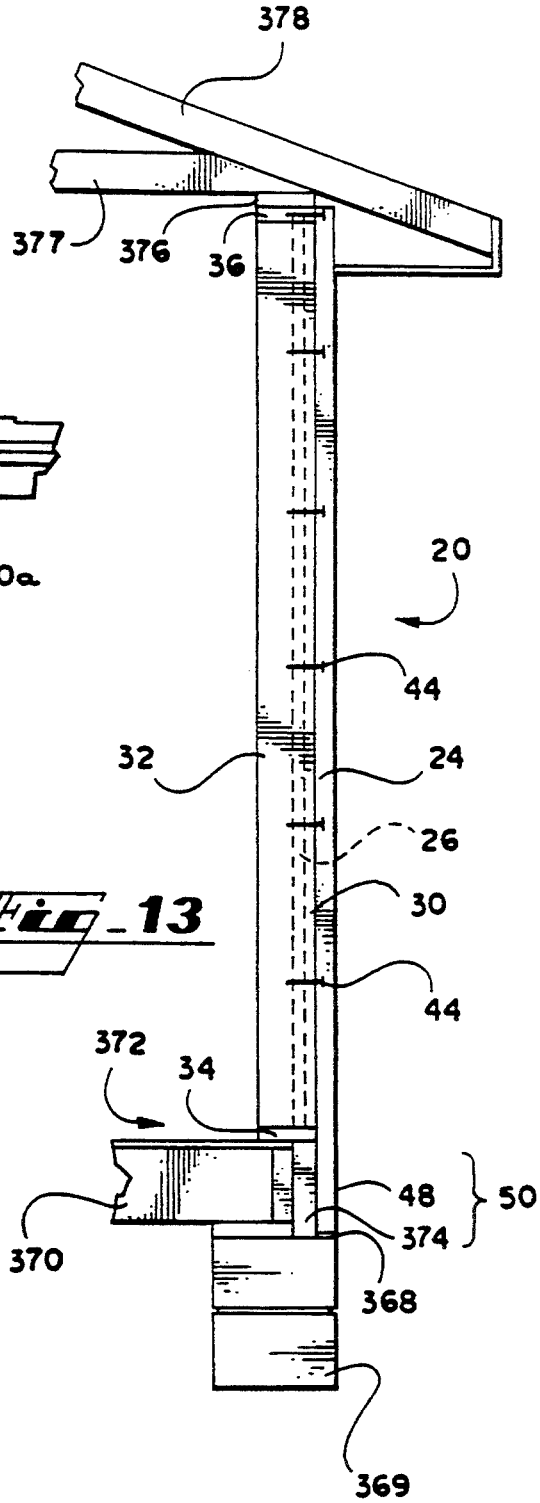
FIG. 13 is a side view of a building with the wall panel illustrated in FIG. 1 forming a part of the exterior wall.

With reference to FIG. 13, the cart 300 is moved on the floor 370 of the building to an edge 372 where the panel 20 is to be installed. The hydraulic cylinder 308 is operated to rotate the lift table 304 upwardly. The footer portion 50 extends over the edge 372 of the floor 370 as the lift table 304 pivots to raise the panel 20 into a vertical position. A sheet of insulation 374 can be placed between the side of the floor 370 and the footer 50. As illustrated in exploded view in FIG. 17, the top edge of the wall panel 20 is preferably held temporarily with the adjacent wall panel 20*a* by a U-channel tool 600 that overlaps the gap 603 between the panels at the top. The wall 20 is held from the top while it is placed in final position next to the adjacent wall panel 20*a* and rigidly secured thereto and to the foundation. The tool 600 includes a pair of side walls 606 and a top 609 connected therebetween to define an inverted through 610 with an open bottom 612. The side walls 606 are preferably disposed at an angle so that the open bottom 612 is wider than the top 609. This permits the trough 610 to catch the top of the walls 20 at a point on the side walls 606 between the open bottom edge 612 and the closed top 609. A handle is preferably connected to one of the side walls 606 medial the longitudinal ends thereof and is disposed parallel to a transverse axis. The handle has a length to permit a worker to reach the trough 610 over the top of the erect wall panels 20. The trough 610 receives the upper ends of the walls panels 20 so that they can be held while the can is withdrawn and the panels rigidly connected together.

With the panel 20 in a near vertical position, the cart 300 is then backed away from the edge of the floor 370. The stop bracket 305 at the bottom of the lift table 304 slides from under the frame 22. The panel 20 may have to be rocked slightly to permit the stop bracket 305 to be withdrawn. The bottom edge 48 of the exterior sheet 24 rests on a footing 368 of a foundation 369 and the bottom plate 34 of the frame 22 rests on the floor 270. The panel 20 is rigidly connected to the floor 370 and to adjacent panels 20. Appropriate caulking, such as rope caulking, seals the joints between adjacent panels 20. The exterior surface of the panels 20 can be stained or painted with traditional materials for finishing concrete.

A top plate 376 is attached to the frame top plate 36 adjacent rafters 377 for the roof 378 and headers are installed over doorways and window spaces. The wall panel 20 provides the dead-air space 30 between the exterior sheet 24 and the insulating sheet 26 for improved insulating characteristics. The interior of the panel 20 may then be closed by nailing a sheet of drywall material, or other interior sheeting, to the interior periphery 29 of the frame 22.

Figure 14:
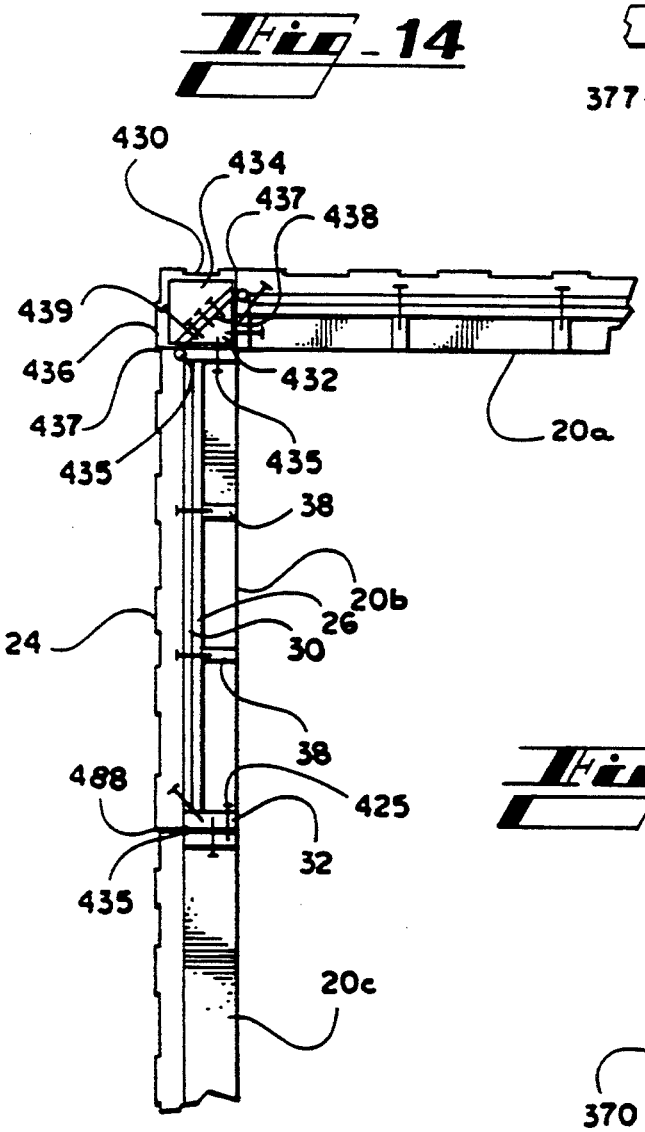
FIG. 14 is a top view of a building comer formed by two wall panels illustrated in FIG. 1 and a corner member, and of a joint between two wall panels.

FIG. 14 is a top view of a building comer formed by two wall panels 20*a* and 20*b*. The wall panels are disposed at perpendicular angles on the edge of the foundation of the building as described above. A corner member 430 inserts into the outwardly facing L-comer defined by the two wall panels 20*a* and 20*b*. In a preferred embodiment, the corner 430 is a composite assembly of an elongate board 432, an insulating member 434, and a concrete exterior 436. A plurality of nails 435 are driven through the side members 32 of the panels 20*a* and 20*b* to rigidly connect the comer member 430 to the panels. A plurality of lengths of rope caulking 435, or the like as appropriate, seals the joints 437 between the comer member 430 and the adjacent wall panels 20 and 20*b* Similar lengths of rope or other extrudable caulking also seals the joints 439 between adjacent wall panels, for example, panels 20*b* and 20*c*, which are rigidly connected by nails at the joint 439.

The comer member 430 is formed in a mold (not illustrated). The mold in cross section defines a V-shape and is supported in a stand with the V pointed downward. The inside surfaces of the mold includes a form liner to match the selected exterior ornamental appearance of the building. A square beam is ripped diagonally to form a wedge-shaped section, such as the wood wedge 432. The insulating member 434 is secured to the face 438 of the wedge 432 with a plurality of nails. The nails are left extending from the member 434. In an especially preferred embodiment, a beam of the insulating sheet 434 is also cut in a wedge shape. The matching faces of the insulating sheet 434 and the wedge 432 abut together and the insulating sheet 434 is secured with nails to the wedge 432.

Concrete is poured into the mold on top of the form liner. The assembled comer 432 and insulating sheet 434 are inserted into the mold with the insulating member 434 embedded into the fluidal cementitious material, thereby forcing the material to fill a V-shaped space between the member 434 and the mold with the nails protruding into the material. After curing, the finished comer 430 is removed from the mold. The comer member 430 is installed by raising it from the outside of the wall into the comer. A length of tubing with a pulley at a distal end can be attached to the cart 300 to be a boom that is positionable over the upper edge of the wall panels in the comer for raising and positioning the corner member 430. A support attached to the boom rests on the upper surface of the wall panels, and the cable 310 passes over the pulley. The end of the cable 310 connects to the comer member 430, such as with an eye bolt or the like, and the winch is operated to lift the comer member 430 into position on the outside of the wall. In a preferred embodiment of the corner 430, a beam of treated lumber having a cross section of six by six nominal inches is used for the comer 430. The combined wood wedge 432 and the insulating member 434 have a cross-sectional width of approximately five and one-half inches. The cementitious exterior sheet 436 is approximately two to two and half inches deep between the exterior face and the insulating member 434.

Figure 15A:
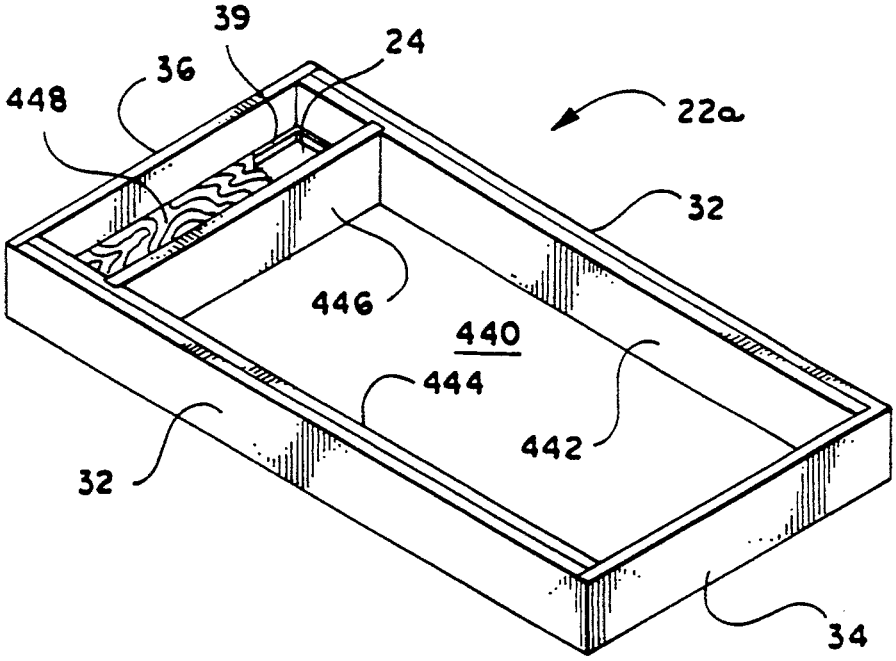
FIG. 15*a* is a perspective view of a frame for a wall panel having a doorway.

The wall panel 20 illustrated in FIG. 1 provides an exterior sheet 24 without openings for windows and doors. The frame 22, however, is readily adapted to providing such openings. FIG. 15*a* illustrates a perspective view of a frame 22*a* having a doorway opening 440. A pair of boards 442 and 444 are disposed against the side members 22 parallel to the longitudinal axis of the frame 22. A header board 446 is connected in notches between the boards 442 and 444 to define the top of the door opening. A plywood fascia board 448 is inserted between the top plate 36, the side members 32, and the header board 446. The header board 446 preferably has a slot that aligns with the slots 39 in the top plate and the side members. The slots receive the edges of the board 448. A bulkhead (discussed below) matching the outline of the frame for the doorway 440 inserts into the casting form 136 to prevent the cementitious exterior sheet 24 from being formed over the doorway.

Figure 15B:
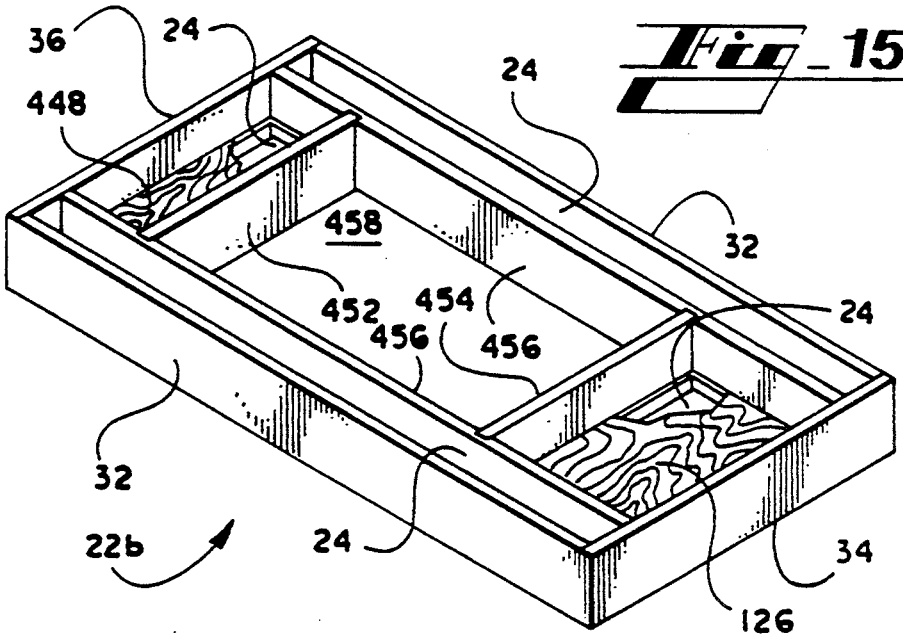
FIG. 15*b* is a perspective view of a frame for a wall panel having a window frame.

Similarly, FIG. 15*b* illustrates a window frame defined by a pair of members 456 disposed parallel to the side members 32 and rigidly connected to the top plate 36 and the bottom plate 34. A pair of horizontal boards 452 and 454 are connected in notches between the members 456 to form a window frame 458. A plywood fascia board 448 inserts as discussed above into slots 39 in the top members 456, and the board 452. The members 456 and 454 are grooved to receive the edges of the sheet of insulation 26. A bulkhead installs in the casting form 136 so that the cementitious exterior sheet includes an opening for the window 458.

Figure 15C:
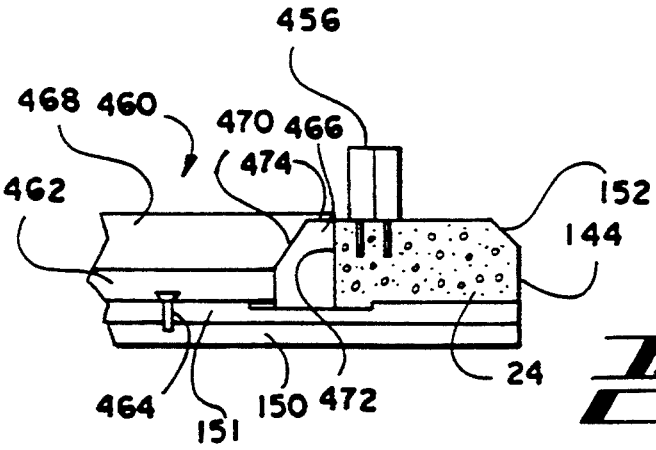
FIG. 15*c* is a side view of a bulkhead that inserts in the casting form illustrated in FIG. 4*a* to outline an opening for a window or a doorway in the cementitious exterior sheet of the modular wall panel.

FIG. 15*c* illustrates in side view a bulkhead 460 with a line-up pan 462 that is rigidly attached to the plywood sheet 150 of the casting form 136 with a plurality of screws 464. The line-up pan 462 outlines the window or doorway in the cementitious exterior sheet 24; for example, the boards 452, 454, and the 456 for the window frame 458 discussed above are shown. A rubber ring 466 or the like is disposed around the periphery of the line-up pan 464 as a dam against the fluidal cementitious material. A core pan 468 sits on the line-up pan 462 and abuts the back side of the ring 466 as a support and to prevent the cement from flowing under the ring. The core pan 468 includes an angled side 470 that conforms the the inside face 472 of the rubber ring 466 and a flange 474 that extends outwardly over the upper face 476 of the ring. The flange 474 helps prevent leakage of cement past the rubber ring 466.

Figure 16D:
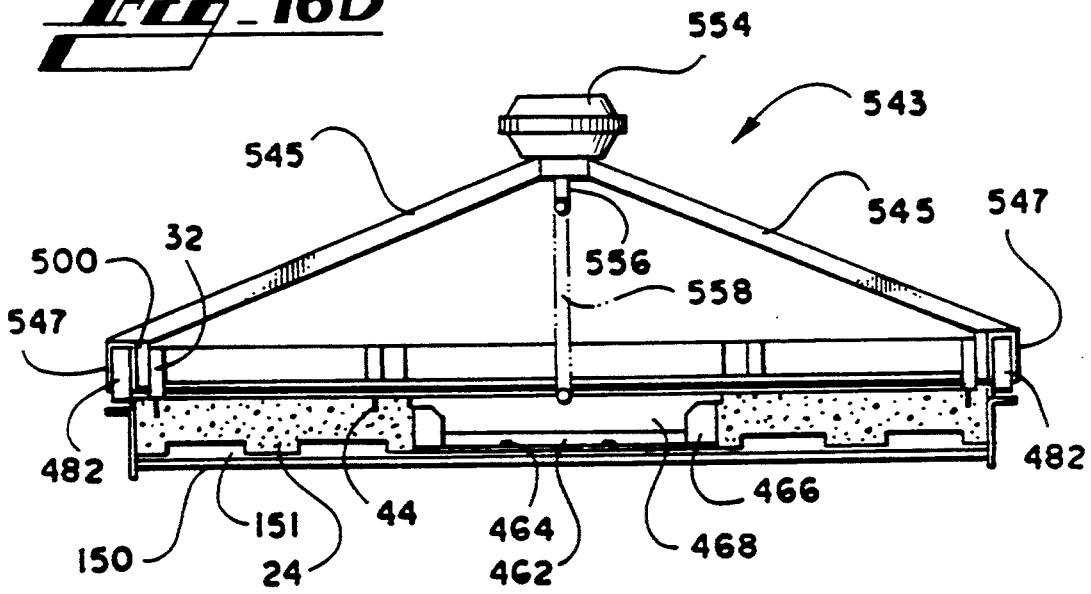
FIG. 16*d* is a side view of a jig that sits on the squaring jig for removing a core pan from the bulkhead that outlines an opening in the cementitious exterior sheet for a window or doorway, as illustrated in FIG. 15*b*.

FIG. 16*d* is side view illustrating a jig 543 that is disposed transversely across the squaring jig 480 discussed above for removing the core pan 468 of a bulkhead 460. The jig 543 includes a pair of spaced-apart A-frames 548 that each include two side supports 545 with an inverted U-shaped clip 547 rigidly attached to the end of each of the supports. The clips 547 forcibly straddle the side tubes 482. An air chamber 554 bolts to an upper surface of each of the A-frames and spans the space between them. A piston arm 556 extends downwardly from the air chamber 554 and connects with a chain 558 to the core pan 468. The air chamber 554 connects to a supply of compressed air and is operable to move the piston arm 556 from a first extended position to a second retracted position to lift the core pan 468 from the casting form 136 before the squaring jig 480 is removed from the frame 22 as discussed above. Similar jigs may be assembled for lifting a large core pan or for lifting a core pan from an area that is off-center of the casting form.

Removal of the core pan 468 is accomplished by positioning the jig 543 over the core pan 468 and engaging the inverted U-shaped clips 547 with the side tubes 482. The chain 558 extending from the piston arm 556 is then connected to a lug (not illustrated) on the core pan, and the air chamber is operated with a supply of compressed air to retract the piston arm from a first extended position to a second retracted position. As the piston arm 556 retracts, the core pan 468 is raised from the casting form 136 and is then manually moved away from the casting form.

Figure 16E:
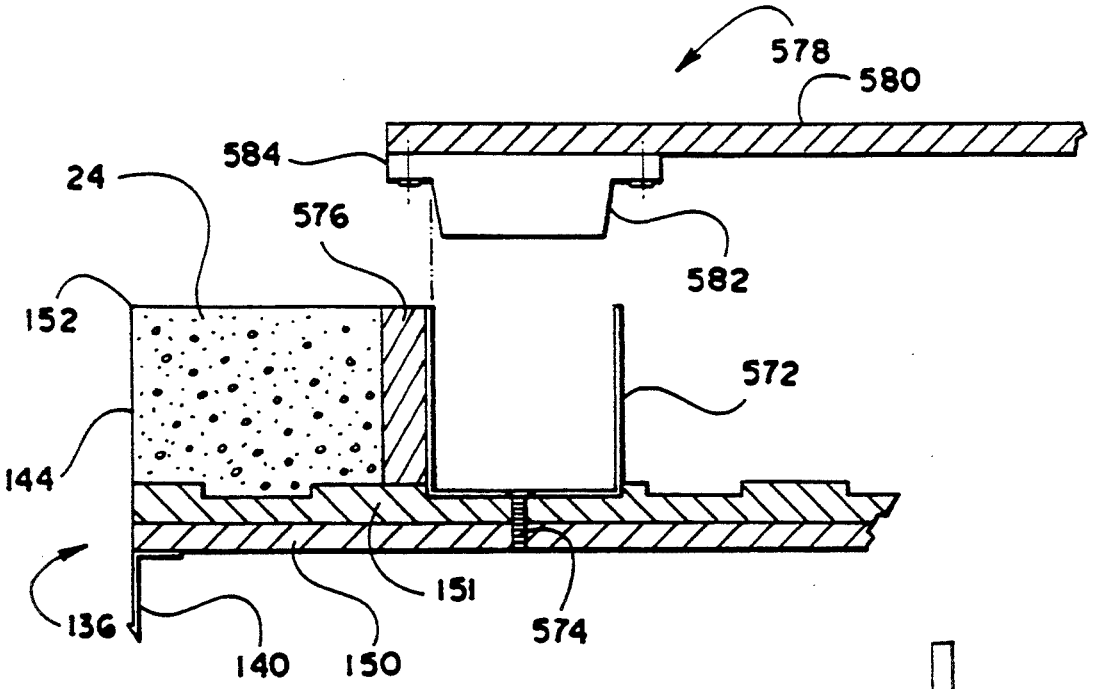
FIG. 16*e* is a cross-sectional view of a preferred embodiment of a bulkhead for defining an opening in the cementitious exterior sheet.

FIG. 16*e* illustrates in cross-sectional view a preferred bulkhead 570 comprising a U-shaped channel 572 that is connected by a plurality of screws 574 to the plywood sheet 150 of the casting form 136. A plurality of the channels 572 outline the opening in the frame 22, such as the window defined by members 452, 454, and 456 in FIG. 15*b*. A resilient seal 576, such as foam or rubber, is disposed on the form liner 151 on the outer perimeter of the channels 572. A core pan 578 covers the opening defined by the channels 572. The core pan 578 includes a cover 580 and a plurality of U-channels 582 that conform in orientation to the opening as outlined by the channels 572. The inverted U-channels 582 insert into the open U-channels 572 in the bulkhead. The channels 582 are connected with screws to the cover 580 and a lip 584 extends laterally from the cover 580 over the upper surface of the seal 576.

The core pan is placed on the opening by inserting the inverted channels 582 into the open channels 572 attached to the plywood 150. The lip 584 covers the seal 576 and prevents its being dislodged when the cementitious material is poured into the cavity 148. The core pan 578 is removed from the casting form 136 prior to operating the elevator to lower the casting form onto the guiderails 125 as discussed above.

Figure 16F:
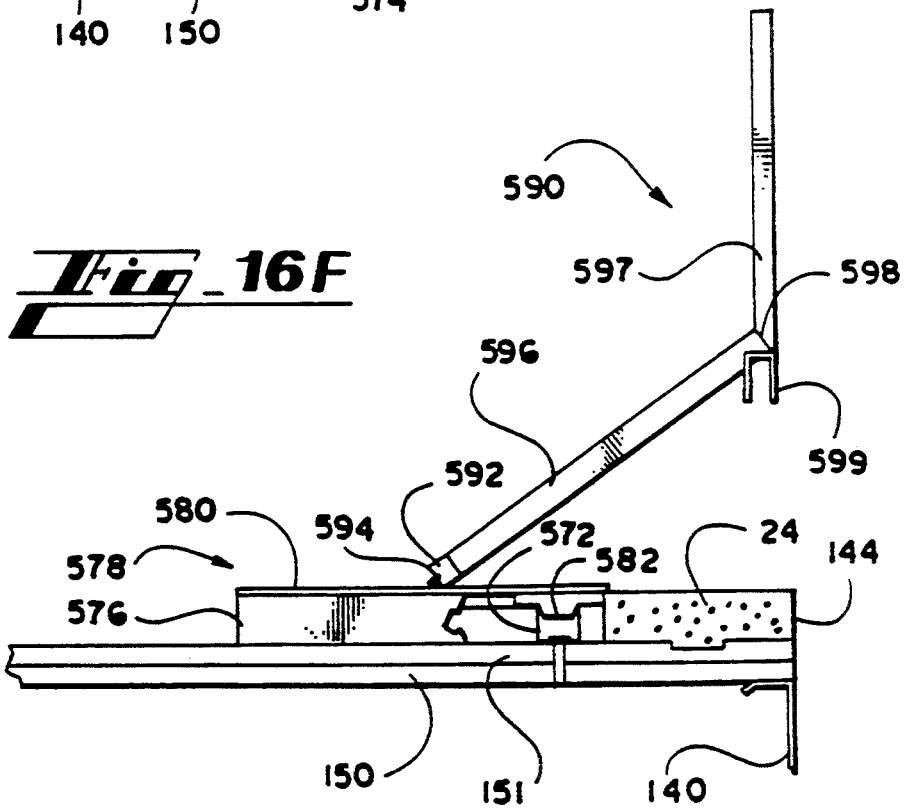
FIG. 16*f* is a tool used to remove a core pan from the bulkhead illustrated in FIG. 16*e*.

FIG. 16*f* illustrates a tool 590 that is used to position and to remove the core pan 578 from the casting form. The tool 590 includes a contact bar 592 generally aligned on an axis of the core pan 578 for balancing the weight thereof on the tool. A pin 594 rigidly connects to each end of the bar 592 and curves outwardly. The tool 590 includes a first arm 596 that connects to the middle of the bar 592 and extends laterally therefrom. A second arm 597 angularly connects at a junction 598 to a distal end of the first arm 596. The junction 598 between the first and the second arms defines a fulcrum, and an open U-channel 599 connects to a bottom surface of the junction. The tool 590 is operated by inserting the pins 594 in respective holes in the cover 580 of the core pan 578. The second arm 597 is lowered to engage the channel 599 with the side rail 144 of the casting form. Downward pressure is applied to the end of the second arm 597 which causes the first arm 596 to pivot upwardly around the fulcrum and thereby raise the core pan 578 from the casting form 136. It may be necessary to inject air into the cavity between the cover 580 and the form liner 151 to assist raising the core pan 578.

It will be appreciated from this discussion that other arrangements in the intermediate members of the frame 22 can readily accommodate variations in doorways and windows. The modular panel of the present invention accordingly increases the flexibility for the exterior ornamental design for modular buildings to include windows and doors, without sacrificing cost savings, strength, insulative characteristics, and ease of assembly of the modular panels and the building.

The principles, preferred embodiments and modes of operation of the present invention have been described in the foregoing specification. The invention is not to be construed as limited to the particular forms disclosed, because these are regarded as illustrative rather than restrictive. Moreover, variations and changes may be made by those skilled in the art without departing from the spirit of the invention as set forth by the following claims.

What is claimed is:

1. A cart for transporting and handling a modular wall panel for assembling a wall of a building, comprising:

a wheeled frame;

a table pivotally attached to an upwardly extending support member of the wheeled frame, the table having a front loading end for receiving a modular wall panel;

a stop bracket attached at a rear unloading end opposite the front loading end of the table, the stop bracket extending upwardly from the table for engaging the modular wall panel when placed on the table; and a hydraulic cylinder pivotally connected between a point on the wheeled frame forwardly spaced from the support member and a point on the table between the support member and the front loading end, the hydraulic cylinder being operable to pivot the table from a first position, wherein the table slopes downwardly below horizontal to the front loading end, to a second generally vertical position, wherein the stop bracket is in contact with a building base to allow removal of the wall panel.

2. The cart for transporting and handling a modular wall panel for assembling a wall of a building as recited in claim 1 further comprising:

a winch operatively associated with the table;

a cable joined to the winch, the cable passing over the front end of the table; and a bracket attached to a distal end of the cable for engaging a top end of a modular wall panel, the winch being operable to move the modular wall panel onto the table until a bottom end of the wall panel contacts the stop bracket.

3. The cart for transporting and handling a modular wall panel for assembling a wall of a building as recited in claim 1 wherein the can is hand movable and positionable.

4. The cart for transporting and handling a modular wall panel for assembling a wall of a building as recited in claim 1 wherein the table has a first section formed between the front end and the support member and a second section formed between the rear end and the support member, and wherein the first section is substantially longer then the second section such that the front end may be raised and lowered to substantially different heights while maintaining a relatively small angle between the table and a horizontal plane.

* * * * *